US008497640B2

(12) United States Patent
Feldtkeller

(10) Patent No.: US 8,497,640 B2
(45) Date of Patent: Jul. 30, 2013

(54) METHOD FOR OPERATING A FLUORESCENT LAMP

(71) Applicant: Infineon Technologies Austria AG, Villach (AT)

(72) Inventor: Martin Feldtkeller, Munich (DE)

(73) Assignee: Infineon Technologies Austria AG, Villach (AT)

( * ) Notice: Subject to any disclaimer, the term of this patent is extended or adjusted under 35 U.S.C. 154(b) by 0 days.

(21) Appl. No.: 13/711,019

(22) Filed: Dec. 11, 2012

(65) Prior Publication Data

US 2013/0099695 A1 Apr. 25, 2013

Related U.S. Application Data

(62) Division of application No. 13/107,403, filed on May 13, 2011, now Pat. No. 8,344,640, which is a division of application No. 11/961,359, filed on Dec. 20, 2007, now Pat. No. 7,990,073.

(30) Foreign Application Priority Data

Dec. 22, 2006 (DE) ..... 10 2006 061 357

(51) Int. Cl.
*G05F 1/00* (2006.01)

(52) U.S. Cl.
USPC ..... 315/291; 315/246; 315/209 R; 315/224; 315/307

(58) Field of Classification Search
USPC ..... 315/209 R, 224, 225, 219, 246, 291, 315/307, DIG. 4, DIG. 7, DIG. 5
See application file for complete search history.

(56) References Cited

U.S. PATENT DOCUMENTS

| | | | | |
|---|---|---|---|---|
| 6,525,492 | B2 | 2/2003 | Ribarich | |
| 6,617,805 | B2 | 9/2003 | Ribarich et al. | |
| 2005/0035724 | A1 * | 2/2005 | Lurkens | 315/291 |
| 2009/0284162 | A1 | 11/2009 | Feldtkeller | |
| 2011/0187335 | A1 | 8/2011 | Grakist et al. | |

FOREIGN PATENT DOCUMENTS

| | | |
|---|---|---|
| DE | 102004037389 | 3/2006 |
| EP | 0474287 | 11/1995 |
| EP | 1066739 | 2/2002 |
| EP | 1333707 | 8/2003 |
| EP | 1337133 | 8/2003 |

OTHER PUBLICATIONS

Office Action mailed Jun. 8, 2012 in U.S. Appl. No. 13/107,403.
Infineon Technologies AG, Smart Ballast Control IC for Fluorescent Lamp Ballasts, Preliminary Datasheet Version 1.5, Jun. 2005, 38 pages.

* cited by examiner

*Primary Examiner* — Tuyet Thi Vo
(74) *Attorney, Agent, or Firm* — Dicke, Billig & Czaja, PLLC

(57) ABSTRACT

A method for operating a fluorescent lamp which is connected to a series resonant circuit with a resonant circuit inductance and a resonant circuit capacitance. The method includes applying an excitation AC voltage at an excitation frequency to the series resonant circuit using a half bridge circuit, which has an output to which the series resonant circuit is coupled, and which has a first and a second switch which are alternately switched on and off on the basis of a frequency signal. A current flowing through the resonant circuit is monitored for the presence of a critical operating state. The switched-on times of the first and second switches are shortened in comparison to switched-on times which are predetermined by the frequency signal, upon detection of a critical operating state.

6 Claims, 20 Drawing Sheets

METHOD FOR OPERATING A FLUORESCENT LAMP

CROSS-REFERENCE TO RELATED APPLICATIONS

This Utility patent application is a divisional application of U.S. application Ser. No. 13/107,403, filed May 13, 2011, which is a divisional application of U.S. application Ser. No. 11/961,359, filed Dec. 20, 2007, which claims the benefit of German Patent Application DE 10 2006 061 357.0, filed Dec. 22, 2006, all of which are incorporated by reference herein.

BACKGROUND

Lamp ballasts for fluorescent lamps or gas discharge lamps normally have a half bridge circuit and a series resonant circuit which is connected to the half bridge circuit and can be connected to the fluorescent lamp. In this case, the half bridge circuit is used to excite the series resonant circuit and for this purpose produces an AC voltage from a DC voltage which is applied across the half bridge.

A starting phase of a lamp ballast includes a preheating phase and an ignition phase for starting the lamp. During the preheating phase, incandescent filaments in the lamp are heated by setting an AC voltage frequency, which is referred to as the excitation frequency in the following, such that it is above the resonant frequency of the series resonant circuit. During the ignition phase, the excitation frequency is reduced increasingly in the direction of the resonant frequency of the resonant circuit with the aim of increasing the voltage across the fluorescent lamp as a result of a resonant peak to such an extent that a starting voltage for the lamp is reached, and that the lamp starts. During an operating phase after the lamp has been started, the excitation frequency can therefore be reduced further again.

During the ignition phase, one aim in this case is to ensure that the voltage across the lamp can rise up to the value of the starting voltage. On the other hand, another aim is to ensure, for safety reasons, that the voltage does not continue to rise indefinitely, for example when the lamp does not start because of a defect or when no lamp is connected to the resonant circuit. For this purpose, U.S. Pat. No. 6,525,492 proposes that a current through the half bridge be detected, and that the half bridge be switched off immediately when the current exceeds a predetermined threshold value.

For cost reasons the coil of the resonant circuit is frequently of such a size that it is already operating close to its magnetic saturation when the lamp voltage is in the region of the starting voltage. As is known, the effective inductance of a coil decreases when it changes to the saturation range. If an excitation frequency at which the coil starts to enter saturation is reached during the starting process, then the resonant frequency of the series resonant circuit increases because of the decreased inductance of the coil, and the margin between the instantaneous excitation frequency and the resonant frequency decreases. If the excitation frequency remains constant, the voltage continues to rise, the coil goes further into saturation, and the resonant frequency becomes even closer to the instantaneous excitation frequency. This positive-feedback effect that has been explained can result in instabilities in the setting of the starting voltage.

For these and other reasons, there is a need for the present invention.

SUMMARY

The present disclosure relates to a method for operating a fluorescent lamp which is connected to a series resonant circuit with a resonant circuit inductance and a resonant circuit capacitance. The method includes applying an excitation AC voltage at an excitation frequency to the series resonant circuit using a half bridge circuit, which has an output to which the series resonant circuit is coupled, and which has a first and a second switch which are alternately switched on and off on the basis of a frequency signal. A current flowing through the resonant circuit is monitored for the presence of a critical operating state. The switched-on times of the first and second switches are shortened in comparison to switched-on times which are predetermined by the frequency signal, upon detection of a critical operating state.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

Embodiments will be explained in more detail in the following text with reference to the figures. In this context, it should be noted that the figures are intended only to explain the basic principle and that the illustrated circuit diagrams illustrate only those circuit components which are necessary to understand this basic principle. Unless stated to the contrary, the same reference symbols denote the same circuit components and signals with the same meaning in the figures.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
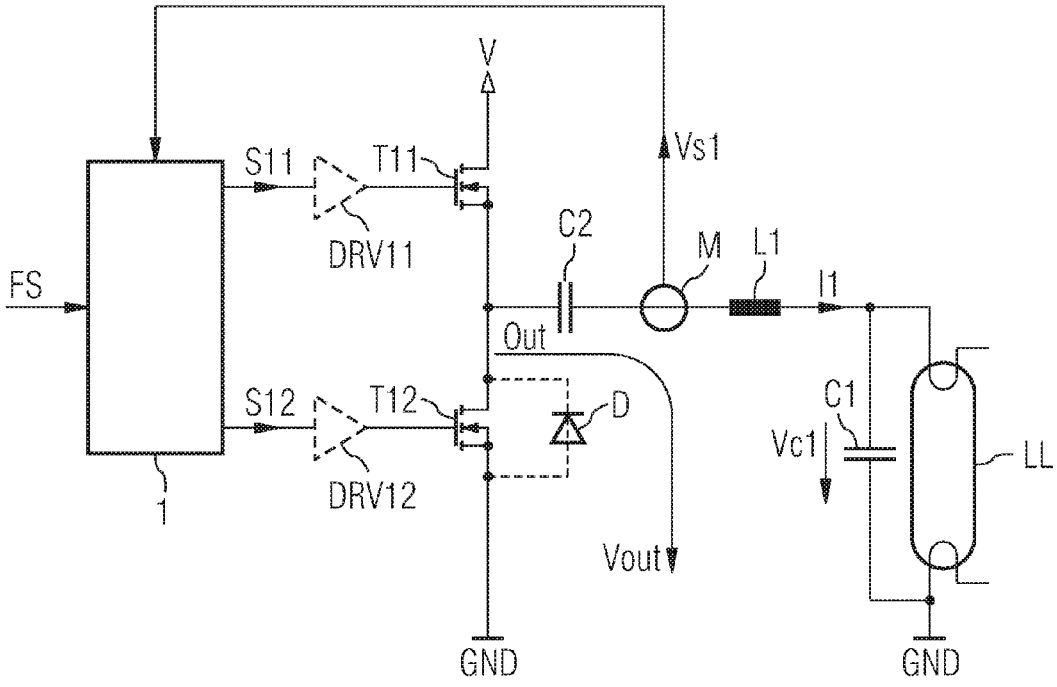
FIG. 1 illustrates the basic design of a lamp ballast according to one exemplary embodiment for operating a fluorescent lamp which has a half bridge with two switches and a series resonant circuit coupled to the half bridge.

FIG. 1 illustrates a first exemplary embodiment of a drive circuit for operating a fluorescent lamp LL. This drive circuit, which is also referred to as a lamp ballast, includes a series resonant circuit with a resonant circuit inductance L1 and a resonant circuit capacitance C1 connected in series with the resonant circuit inductance L1. During operation of the lamp ballast, a fluorescent lamp LL is coupled to the series resonant circuit via heating filaments. The fluorescent lamp LL can be connected in parallel with the resonant circuit capacitance C1 for this purpose, as illustrated in FIG. 1. The free ends of the heating filaments that are remote from the resonant circuit capacitance C1 can be connected to a heating circuit in a manner which is not illustrated in any more detail.

The lamp ballast also has a half bridge circuit with a first and a second switch T11, T12, each of which has a drive connection and load paths. The load paths of the switches T11, T12 are in this case connected in series with one another between terminals for a positive supply potential V and a negative supply potential or reference ground potential GND. The half bridge circuit has an output OUT which is formed by a node that is shared by the load paths of the switches T11, T12, and to which the series resonant circuit L1, C1 is coupled. The series resonant circuit L1, C1 is in this case connected between the output OUT and the terminal for the second supply potential GND. In the example, a coupling capacitor C2 is connected between the output OUT and the series resonant circuit L1, C1 and is used to block DC components on an excitation AC voltage Vout, which is produced by the half bridge circuit T11, T12, for the series resonant circuit L1, C1.

The half bridge circuit T11, T12 is used to apply an excitation AC voltage at an excitation frequency to the series resonant circuit. During operation, the switches T11, T12 are switched on and off alternately for this purpose by a drive circuit 1, which will be explained later. When the first switch T11, which is also referred to as a high-side switch or upper half-bridge switch, is switched on, and the second switch T12, which is also referred to as a low-side switch or lower half-bridge switch, is switched off, a voltage is applied across the series resonant circuit L1, C1 which corresponds to the supply voltage applied between the supply potential terminals. When the high-side switch T11 is switched off and the low-side switch T12 is switched on, the voltage across the series resonant circuit is approximately zero.

In the lamp ballast illustrated in FIG. 1, the switches T11, T12 are n-conductive MOSFETs, which each have a gate connection as the control connection, and drain and source connections as load-path connections. In this context, it should be noted that any desired switches may be used as switches for the half bridge circuit, in particular other semiconductor switches such as p-conductive MOSFETs or IGBTs. In particular, it is possible to use complementary semiconductor switches, for example with the high-side switch T11 being a p-MOSFET, and the low-side switch T12 being an n-MOSFET.

Particularly in order to reliably avoid parallel currents, the switches T11, T12 are operated in such a way that a waiting time, the "dead time", is allowed to pass between one switch being switched off and the other switch being switched on. A freewheeling current in the series resonant circuit can be passed during this dead time through a freewheeling element, for example a diode D, which is connected in parallel with the low-side switch. When an n-conductive MOSFET is used at the low-side switch, a body diode integrated in the MOSFET can be used to carry out this freewheeling function, so that there is no need for an external freewheeling element.

A drive circuit 1 is provided in order to operate the switches T11, T12 in the half bridge circuit, and produces a first drive signal S11 to operate the high-side switch T11, and a second drive signal S12 to operate the low-side switch T12. The drive connections of the switches T11, T12 are optionally preceded by driver circuits DRV11, DRV12 which are used to convert the signal levels of the drive signals S11, S12 to signal levels that are suitable for operating the switches T11, T12.

The drive circuit 1 is supplied with a frequency signal FS which governs the frequency with which the switches T11, T12 are operated alternately, and which therefore governs the excitation frequency of the series resonant circuit L1, C1. This frequency signal FS is produced in a manner that is not illustrated in any more detail, for example by a central control circuit, which controls the operation of the lamp ballast.

Figure 2:
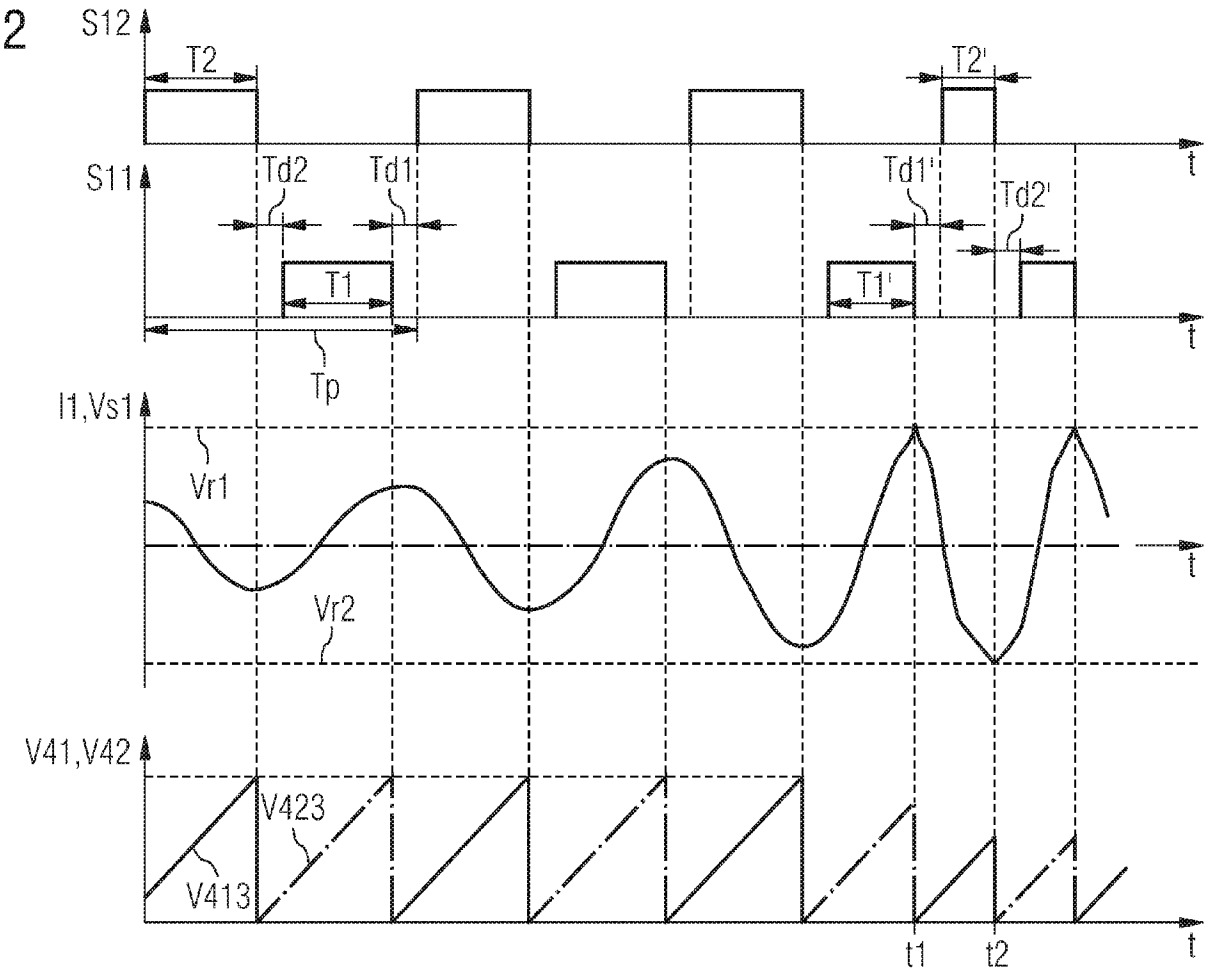
FIG. 2 illustrates a method for operating the fluorescent lamp by way of timing diagrams of signals which occur in the lamp ballast.

Waveforms over time of the first and second drive signals S11, S12 produced by the drive circuit 1 are illustrated by way of example in FIG. 2. Without any restriction to the invention, the following explanation is based on the assumption that these drive signals S11, S12 are binary signals, which alternately assume a high level and a low level, and that the switches T11, T12 are switched on when the respective drive signal S11, S12 is at a high level, and are switched off when the respective drive signal is at a low level.

During a drive period, which is annotated Tp in FIG. 2, the first switch is switched on for a first switched-on time T1, after which the second switch is switched on for a second switched-on time T2, successively. Td1 in FIG. 2 denotes a first dead time after the first switch T11 is switched off and before the second switch T12 is switched on. Td2 denotes a second dead time after the second switch T12 has been switched off and before the first switch T11 is switched on. The excitation frequency f of the voltage applied to the series resonant circuit L1, C1 via the half bridge circuit T11, T12 in this case corresponds to the reciprocal of the period duration, so that: f=1/Tp.

In addition to the drive signals S11, S12, FIG. 2 illustrates the waveform over time of a current I1 through the series circuit and a current measurement signal which is produced by a measurement arrangement M connected in the series resonant circuit. This current measurement signal Vs1 is in this case at least approximately proportional to the resonant circuit current I1. FIG. 2 illustrates the waveform over time of this current I1 for a time period before starting of the fluorescent lamp LL. In this case, the current I1 through the series resonant circuit has an at least approximately sinusoidal waveform, and the frequency of this sinusoidal signal waveform corresponds to the excitation frequency f. In order to start the fluorescent lamp, the excitation frequency is gradually decreased by the frequency signal FS, starting from an initial value which is higher than a resonant frequency of the resonant circuit L1, C1. This is equivalent to lengthening the period duration Tp, and therefore to lengthening the first and second switched-on times T1, T2. In this case, the dead times Td1, Td2 may be independent of the switched-on times T1, T2 and may have a predetermined constant value.

A reduction in the excitation frequency of the AC voltage is used to excite the resonant circuit L1, C1, in the direction of the resonant frequency, results in an increase in the maximum amplitude value of the current I1 flowing through the series resonant circuit, and of an AC voltage Vc1 which is applied across the resonant circuit capacitor C1. The waveform over time of this voltage Vc1 follows the waveform over time of the current I1, with a phase shift. When this voltage reaches the value of the starting voltage for the fluorescent lamp LL as the excitation frequency falls, and the fluorescent lamp is started, then the excitation frequency can be reduced further to the value of the operating frequency, by the control circuit. In this case, the power consumed by the fluorescent lamp is supplied via the excitation voltage, and the current waveform is then no longer sinusoidal, in a manner which is not illustrated in any more detail, once the fluorescent lamp has been started. The frequency can be reduced further to the operating frequency after the fluorescent lamp has been started by using conventionally known measures, so that there is no need to explain these any further.

In order to keep the material costs for the resonant circuit inductance L1 as low as possible, it is desirable for it to be magnetized into saturation while the resonant circuit current I1 that is required to start the fluorescent lamp is flowing, with the positive-feedback effect that was explained initially being taken into account in this context. One embodiment of the invention now provides for the resonant circuit inductance L1 to be monitored for the start of saturation during a starting process, that is to say during a time period during which the fluorescent lamp LL has not yet been started, and for the times for which the first and second switches are switched on to be shortened on detection of such incipient saturation. Incipient saturation of the resonant circuit inductance L1 is detected in the case of the method illustrated in FIG. 2 by comparison of the measurement signal Vs1, which is proportional to the resonant circuit I1, with a first and a second threshold value Vr1, Vr2. If the measurement signal Vs1 rises while the first switch is switched on to the value of the first threshold value Vr1, then the first switch T11 is switched off immediately, and even before the "normal" switched-on time, which is dependent on the excitation frequency, is reached. If the measurement signal Vs1 reaches the value of the lower threshold value Vr2 when the second switch T12 is switched on, then the second switch is switched off immediately, and even before the switched-on time, which is dependent on the excitation frequency, is reached. This in each case leads to the times for which the first and second switches T11, T12 are switched on being shortened in comparison to the times for which they are switched on as a function of the instantaneous excitation frequency. When one of the switches is switched off prematurely as a result of saturation, as already explained, a dead time Td1' or Td2', respectively, is allowed to pass before the other switch is switched on in which case these dead times may in each case be the same and, in particular, may correspond to the dead times Td1, Td2 during those operating phases in which premature switching off as a result of saturation does not occur. Effectively, switching the switches off prematurely as a result of saturation leads to an increase in the excitation frequency, and therefore counteracts any further resonant peak, and thus any further rise in the voltage in the resonant circuit L1, C1. In particular, this avoids the positive-feedback effect explained initially.

Figure 3:
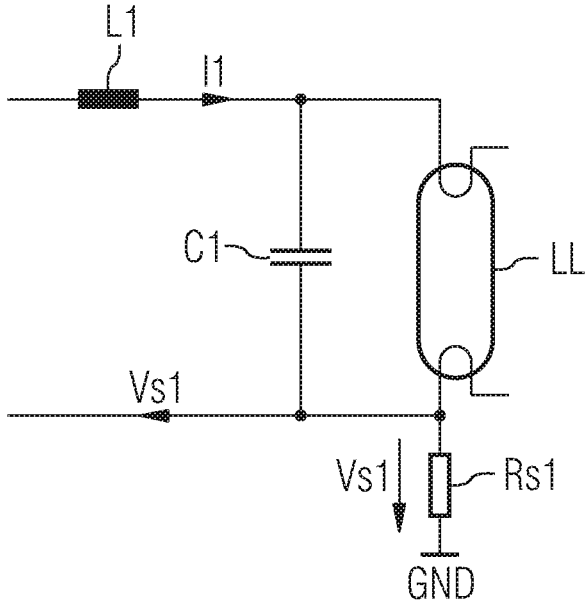
FIG. 3 illustrates one possible way to detect the current through the series resonant circuit.

The measurement signal Vs1, which is at least approximately proportional to the resonant circuit current I1, can be produced in various ways. FIG. 3 illustrates a detail of a lamp ballast in which, in order to produce the measurement signal Vs1, a measurement resistor Rs1 which behaves at least approximately as a pure resistance is connected in series with the series resonant circuit L1, C1 and, in the example, between the series resonant circuit L1, C1 and the second supply potential GND. The voltage across this measurement resistor Rs1 in this case corresponds to the current measurement signal Vs1.

Figure 4:
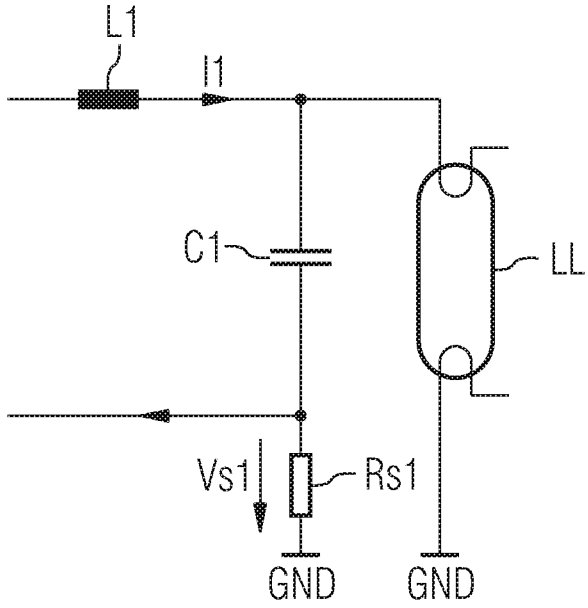
FIG. 4 illustrates one possible way to detect the current through the series resonant circuit.

In the lamp ballast illustrated in FIG. 3, the measurement resistor Rs1 is connected to the parallel circuit formed by the resonant circuit capacitance C1 and the fluorescent lamp LL. FIG. 4 illustrates a modification of the lamp ballast illustrated in FIG. 3, in which the measurement resistor Rs1 is likewise connected between the series resonant circuit L1, C1 and the terminal for the second supply potential GND, but in which the fluorescent lamp LL is connected in parallel with 2 series circuit formed by the resonant circuit capacitance C1 and the measurement resistor Rs1. In the method explained above, the resistance of the measurement resistor Rs1, the first and second threshold values Vr1, Vr2 and a quotient of the inductance value of the resonant circuit inductance and the capacitance value of the resonant circuit capacitance govern the maximum starting voltage that occurs.

A circuitry implementation example of a drive circuit with the functionality as explained above in order to shorten the times for which the first and second switches T11, T12 in the half bridge circuit are switched on in the event of incipient saturation of the resonant circuit inductance L1 will be explained in the following text with reference to FIG. 5. In the illustrated example, this drive circuit 1 includes an oscillator 4, a dead-time circuit 5 connected downstream from the oscillator 4, and a comparator arrangement or switch-on limiting arrangement 3, connected to the oscillator 4.

The oscillator arrangement 4 is designed to produce a clock signal S4, at a frequency which is dependent on the frequency signal FS, at an output. This clock signal S4 in the case of the drive circuit 1 illustrated in FIG. 5 is a binary clock signal whose waveform over time is illustrated by way of example in FIG. 6. In the illustrated example, this clock signal is alternately at a high level and a low level. The period duration Tp of this clock signal S4 predetermines, in a manner which is still to be explained, the period duration of a drive cycle for the resonant circuit. During time periods in which the frequency signal FS does not change, and during which neither of the switches T11, T12 in the half-bridge circuit is switched off as a result of saturation, the time period of a high level corresponds to the time period of a low level during the drive period Tp.

Figure 6:
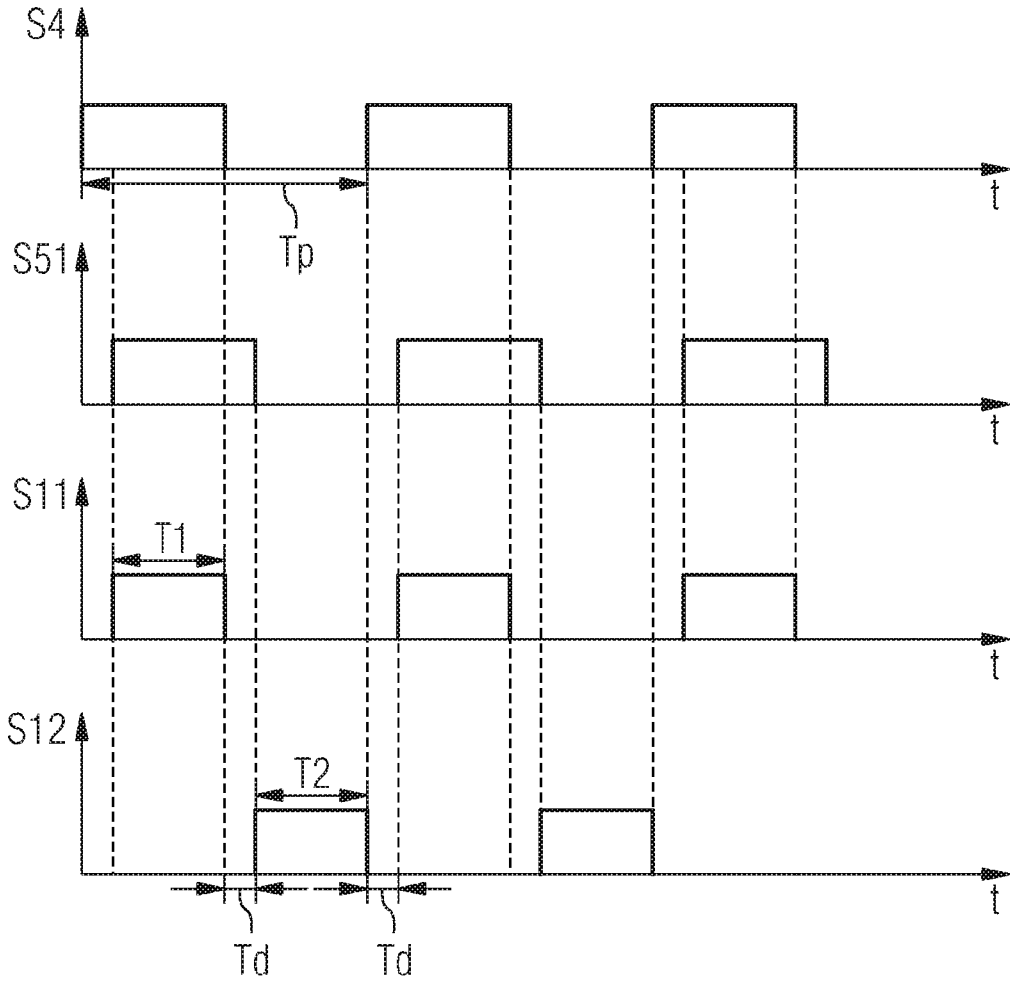
FIG. 6 illustrates timing diagrams of signals which occur in the drive circuit illustrated in FIG. 5.

The dead-time circuit 5 uses this clock signal S4 to produce the first and second drive signals 511, S12. In the illustrated example, the dead-time circuit 5 includes a delay element 51, to which the clock signal S4 is supplied and which produces an output signal S51, which corresponds to the clock signal S4 delayed by a delay time Td. FIG. 6 illustrates the waveform of this output signal S51 over time. In addition, the dead-time circuit 5 has two logic gates 51, 53, to which the clock signal S4 and the delayed clock signal S51 are respectively supplied, and which respectively produce one of the drive signals S11, S12. The first drive signal S11 is produced at the output of the first logic gate 52, which in the example is in the form of an AND gate. During time periods such as these, this drive signal S11 assumes a high level, during which the clock signal S4 and the delayed clock signal S51 are at a high level. FIG. 6 likewise illustrates the waveform over time of this first drive signal S11, which results from the clock signal S4 and the delayed clock signal S51. The second drive signal S12 is produced at the output of the second logic gate 53 which, in the example, is in the form of a NOR gate. This drive signal S12 assumes a high level during those time periods during which both the clock signal S4 and the delayed clock signal S51 assume a low level. The dead time between a high level of the first drive signal S11, that is to say the point at which the first switch T11 is switched on, and a high level of the second drive signal S12, that is to say the point which the second switch T12 is switched on, is governed in the case of the illustrated dead-time circuit 5 by the delay time Td of the delay element 51. During this dead time, the clock signal S4 and the delayed clock signal S51 are each at mutually complementary signal levels, so that both the first and the second drive signal S11, S12 assume a low level. The dead time between the first switch being switched off and the second switch being switched on in this case corresponds to the dead time between the second switch being switched off and the first switch being switched on.

In the case of the oscillator arrangement illustrated in FIG. 4, the clock signal S4 is produced at an output, in the example at the inverting output of a flipflop 43. In the illustrated example, this flipflop 43 is an RS flipflop with a set input S and a reset input R. However, of course, it is also possible to use some other flipflop, for example a toggle flipflop, instead of this RS flipflop. The illustrated oscillator arrangement 4 has signal generators 41, 42 which are alternately activated and deactivated by the flipflop 43, with in each case one of them predetermining the time for which the clock signal S4 is at a high level, and the other predetermining the time for which the clock signal S4 is at a low level. The first signal generator 41 is in this case operated by a signal at the non-inverting output of the flipflop 43, and produces a control signal S41 which is fed back to the set input S of the flipflop. The second signal generator 42 is operated by a signal at the inverting output, that is to say in the example the clock signal S4, and produces a second control signal S42, which is fed back to the reset input R of the flipflop 43. The signal generators 41, 42 in the illustrated oscillator arrangement 4 are each activated when the flip flop output signals change to a low level. The first signal generator 41 is activated when the flipflop is reset, and sets the flipflop 43 once a time period which is governed by the signal generator has passed. When the flipflop 43 is reset, the clock signal S4 assumes a high level, and it assumes a low level when the flipflop is set. The first signal generator 41 thus governs the time for which the clock signal S4 is at a high level. The second signal generator 42 is activated when the flipflop 43 is set, and resets the flipflop 43 once a time period which is governed by this signal generator 42 has passed. The clock signal S4 assumes a low level when the flipflop 43 is set, and assumes a high level when the flipflop 43 is reset. The second signal generator 42 thus governs the time for which this clock signal S4 is at the low level.

The two signal generators are in the form of sawtooth-waveform signal generators and, when in the activated state, each produce a linearly rising voltage signal V413, V423. The control signals S41, S42 of these signal generators 41, 42 are determined by comparison of these linearly rising voltage signals V413, V423 with comparison values V41, V42. For this purpose, the signal generators 41, 42 have a respective comparator 411, 422, whose one input, in the example the positive input, is supplied with the voltage signal V413, V423, which rises linearly when the signal generator is activated, and whose other input, the negative input in the example, is supplied with the comparison signal V41, V42. The control signals S41 for setting the flipflop 43 and S42 for resetting the flip-flop 43 are produced at the output of these comparators 411, 421. The two signal generators 41, 42 each have a series circuit with a respective current source 412, 422 and a capacitive energy storage element 413, 423. A respective switch 414, 424 is connected in parallel with each of the capacitive energy storage elements 413, 423. These switches 414, 424 are operated via the outputs of the flipflop 43 and are used to activate and deactivate the respective signal generator 41, 42. The illustrated signal generators 41, 42 are each activated when the switches 414, 424 are open, and are each deactivated, by shorting the capacitive energy storage element 413, 423, when the switches are closed. In the activated state, the capacitive energy storage elements 413, 423 are charged via the series-connected current sources 412, 422. The voltages which are produced across the capacitive energy storage elements 413, 423 in this case and correspond to the voltage signals V413, V423 then each rise linearly. The method of operation of these signal generators 41, 42, which each operate in the same way, will be explained briefly in the following text with reference to the first signal generator 41.

The signal generator 41 is activated on resetting the flipflop 43, as a result of which the output signal at the inverting output assumes a low level, and the switch 414 is opened. The voltage V413 across the capacitive energy storage element 413 then rises linearly. When this voltage V413 reaches the value of the comparison voltage V41, the control signal S41 at the output of the comparator 411 assumes a high level, as a result of which the flipflop 43 is set, and the signal generator 41 is deactivated. At this time, the second signal generator 42 is activated by opening the switch 424.

The signal generators 41, 42 may, in particular, be designed such that the current produced by the current sources 412, 422 are each the same, the capacitance values of the capacitive storage elements 413, 423 are each the same, and such that the comparison thresholds V41, V42 are each the same. The time periods for production of the clock signal S4, which are predetermined by these signal generators 41, are then the same, so that the clock signal S4 in each case assumes a high level and a low level of equal duration. The frequency of the clock signal S4 produced by this oscillator circuit 4 can be set by the current sources 412, 422. In this case, the current produced by the respective current source 412, 422 is increased, controlled by the frequency signal FS, in order to increase the signal frequency. The time period between activation of the respective signal generator 41, 42 and the time at which the respective voltage signal V413, V423 reaches the value of the comparison signal V41, V42 is thus shortened. Alternatively or additionally, it is also possible to set the frequency of the clock signal S4 by the comparison thresholds V41, V42. In order to increase the clock frequency, these comparison values are reduced for this purpose, thus resulting in the voltage signals V413, V423, which rise when the signal generators 41, 42 are activated, reaching these comparison thresholds more quickly.

Figure 5:
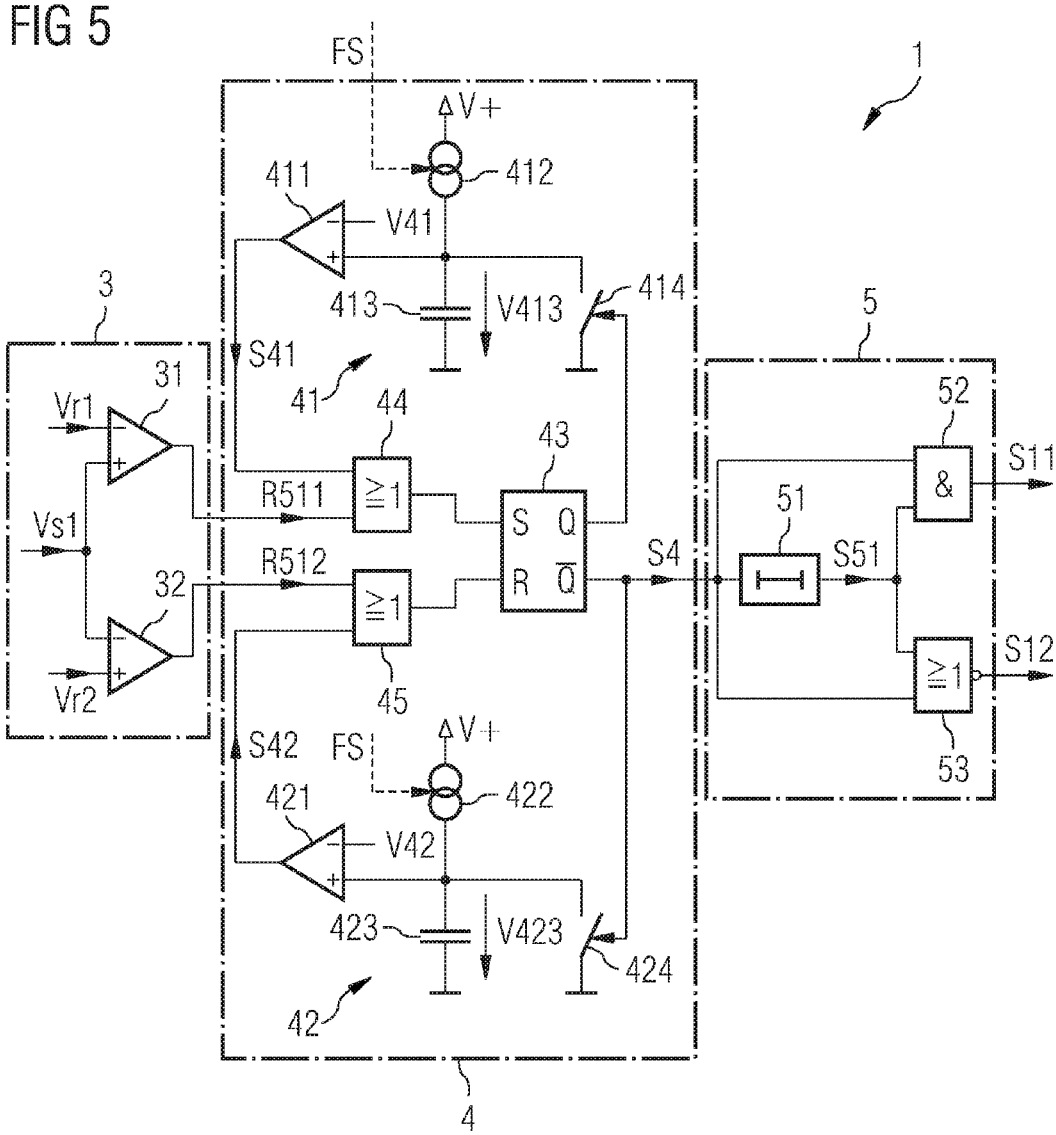
FIG. 5 illustrates one exemplary embodiment of an oscillator arrangement.

The comparator circuit 3 in the drive circuit illustrated in FIG. 5 ensures that the times for which the first and second drive signals S11, S12 are switched on are shortened in the event incipient saturation of the resonant circuit inductance. This comparator circuit 3 produces first and second switch-off signals RS11, RS12 for the first and second semiconductor switches T11, T12 on the basis of a comparison of the current measurement signal Vs1 with the upper and lower comparison values Vr1, Vr2. The first switch-off signal RS11 is produced by comparing the current measurement signal Vs1 with the upper threshold value Vr1. These two signals Vs1, Vr1 are for this purpose supplied to a first comparator 31, at whose output the first switch-off signal RS11 is produced. This switch-off signal RS11 assumes a switch-off level, a high level in the example, when the current measurement signal Vs1 rises to the value of the upper comparison signal Vr1. The second switch-off signal RS12 is produced by comparison of the current measurement signal Vs1 with the lower comparison value Vr2. These two signals Vs1, Vr2 are for this purpose supplied to a second comparator 32, at whose output the second switch-off signal RS12 is produced. This second switch-off signal RS12 assumes a switch-off level, in the example the high level, when the current measurement signal Vs1 falls to the value of the lower comparison signal Vr2.

The two switch-off signals RS11, RS12 are supplied to the oscillator 4 and, when a switch-off level is present, directly influence the clock signal S4, bypassing the signal generators 41, 42. When the first switch-off signal RS11 is at a switch-off level, the clock signal S4 immediately assumes a low level, as a result of which the first switch-on signal S11 assumes a low level, and the first switch T11, which was previously switched on, is switched off. When the second switch-off signal RS12 is at a switch-off level, the clock signal S4 immediately assumes a high level, as a result of which the second drive signal S12 assumes a low level, and the second switch T12, which was previously switched on, is switched off. The first switch-off signal RS11 is for this purpose supplied via a first OR gate 44 to the set input S of the first flipflop 43, and the second switch-off signal RS12 is supplied via a second OR gate 45 to the reset input R of the flipflop 43. In this case, the respective other input of the first OR gate 41 is supplied with the control signal S41 from the first signal generator 41, and the further input of the second OR gate 45 is supplied with the control signal S42 from the second signal generator 42. The OR logic operations on the switch-off signals RS11, RS12 are carried out by the control signals S41, S42 from the signal generators 41, 42, with the clock signal S4 being defined by the signal generators 41 during "normal operation", that is to say when there is no incipient saturation in the resonant circuit inductance, while the clock signal S4 is defined by the switch-off signals RS11, RS12 during the "saturation mode", when the resonant circuit inductance enters saturation.

In order to assist understanding, FIG. 2 illustrates the waveforms over time of the linearly rising voltage signals V413, V423, which are produced by the signal generators 41, for the drive circuit illustrated in FIG. 5. During normal operation, these voltage signals V413, V423 respectively reach the associated comparison values V41, V42 and therefore govern the period duration Tp of a drive cycle. In the saturation mode, when the resonant circuit inductance starts to enter saturation, these voltage signals do not reach the comparison values. The period duration Tp is in this case governed by the switch-off signals RS11, RS12 which, as explained, are produced on the basis of a comparison of the current measurement signal Vs1 with the upper and lower threshold values Vr1, Vr2.

Figure 7:
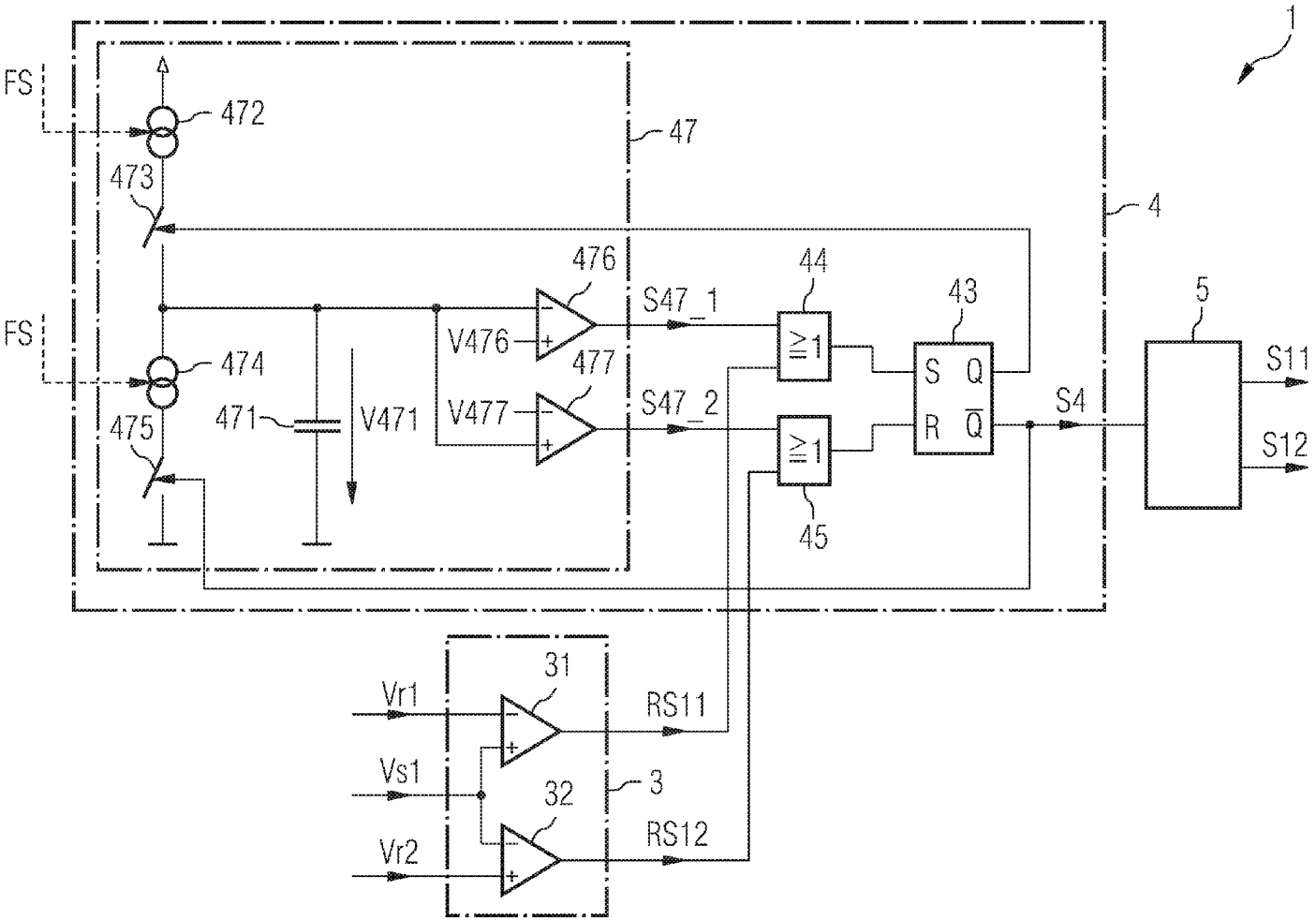
FIG. 7 illustrates a second exemplary embodiment of an oscillator circuit.

FIG. 7 illustrates a drive circuit 1 which has been modified in comparison to the drive circuit illustrated in FIG. 5, and in which the oscillator 4 has only one signal generator 47, which in the example is in the form of a triangular-waveform signal generator. This signal generator 47 has a capacitive energy storage element 471 which is connected via a series circuit including a first current source 472 and a first switch 473 to an upper supply potential, and via a series circuit including a second current source 474 and a second switch 475 to a lower supply potential. The two switches 473, 475 are opened and closed alternately via signals at the outputs of the flipflop 43, with the capacitive energy storage element 471 being charged, when the first switch 473 is closed, via a current which is produced by the first current source 472 and, when the second switch 475 is closed, being discharged via a current which is supplied from the second current source 474. In the case of this signal generator 47, a voltage V471 across the capacitive energy storage element 471 has a triangular signal waveform. This voltage V471 is compared with an upper threshold value V476 by using a first comparator 476, and with a lower threshold value V477 by using a second comparator 477. A first output signal S47_1 from this oscillator 47 is supplied to the set input S of the flipflop 43 via the first OR gate 44, and an output signal S47_1 of the second comparator 477 is supplied to the reset input R of the flipflop 43 via the second OR gate 45. During normal operation, when no switch off as a result of saturation occurs, the first output signal S47_1 from the signal generator 47 sets the flipflop, as a result of which the clock signal assumes a low level, while the second output signal S47_2 resets the flipflop, as a result of which the clock signal S4 assumes a high level. The currents which are produced by the current sources 472, 474 may each be of the same magnitude, which results in the clock signal S4 in each case having high levels and low levels of equal duration. The frequency of the clock signal S4 in the case of the illustrated oscillator 47 can be set via the current sources 472, 474, with the frequency of the clock signal S4 rising when the current produced by the current sources 472, 474 is increased. Furthermore, the frequency of this oscillator 47 can be set via the comparison thresholds V476, V477, with the frequency of the clock signal S4 being increased when these thresholds V476, V477 approach one another, that is to say when the difference between the upper threshold V476 and the lower threshold V477 is decreased.

A further possible way to produce the switch-off signals RS11, RS12 will be explained in the following text with reference to FIG. 8.

Figure 8:
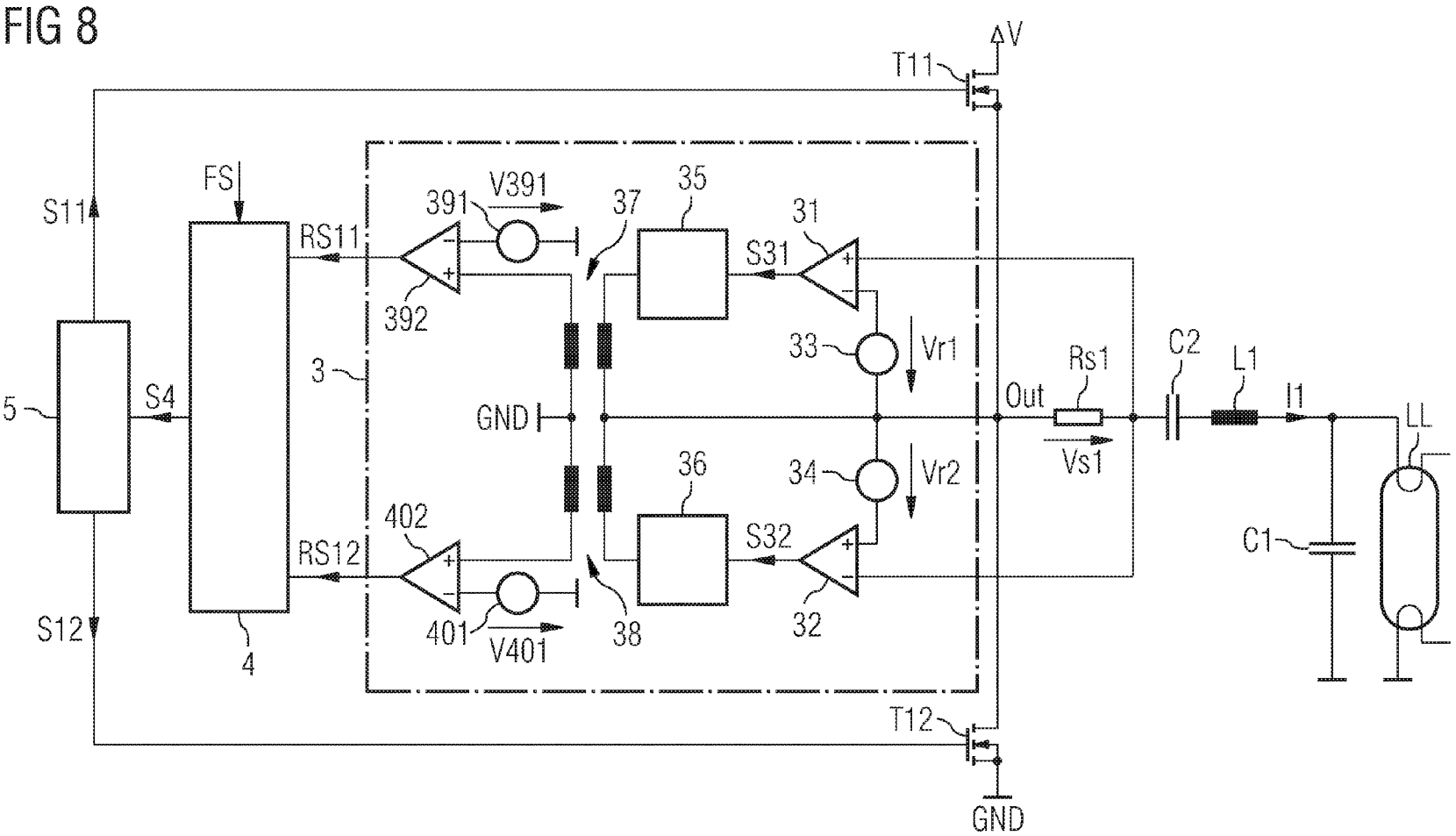
FIG. 8 illustrates another exemplary embodiment of a comparator arrangement which has an inductive transformer.

In the case of the lamp ballast illustrated in FIG. 8, a measurement resistor Rs1 for measurement of a current I1 in the resonant circuit L1, C1 is connected between the output OUT of the half bridge T11, T12 and the resonant circuit L1, C1. A first comparator 31 in the comparator arrangement 3 in this case compares the measurement voltage Vs1 across the measurement resistor Rs1 with the upper threshold value Vr1, and a second comparator 32 compares this voltage Vs2 with a lower threshold value Vr2. In the example, the first comparator 31 is for this purpose connected at one input to a first connection of the measurement resistor Rs1 and at a second input via a voltage source 33, which produces the upper threshold value Vr1, to a second input of the measurement resistor Rs1. In the example, this second input of the measurement resistor is connected to the output OUT of the half bridge T11, T12. A first input of the second comparator 32 is connected via a voltage source 34, which produces the lower threshold value Vr2, to the second input of the measurement resistor Rs1, and via its second input to the first input of the measurement resistor Rs1. The first inputs of the comparators 31, 32 in the example are their positive inputs or their non-inverting inputs, and the second inputs in the example are their negative inputs, or the inverting inputs. The comparators 31, 32 with the voltage sources 33, 34 are connected in the example such that an output signal from the first comparator assumes a high level when the measurement voltage Vs1 exceeds the upper threshold value Vr1, and such that an output signal from the second comparator 32 assumes a high level when the measurement voltage Vs1 is less than the second threshold value Vr2. The signals which are produced at the comparators 31, 32 are related to an electrical potential at the output OUT of the half bridge T11, T12. This electrical potential varies as a function of the switching states of the switches T11, T12 in the half bridge. In a corresponding manner, the output signals 31, 32 from the comparators are related to this output potential from the half bridge. In order to product switch-off signals RS11, RS12 which are related to a fixed potential, for example the reference ground potential GND, from these comparator output signals S31, S32, which are related to the output potential from the half bridge T11, T12, two inductive transformers 37, 38 are provided, which each have primary windings and secondary windings and whose secondary windings are connected to the reference ground potential. By way of example, these transformers are coreless transformers, which may be integrated in or on a semiconductor chip.

Respective modulation circuits 35, 36 are connected between the comparators 31, 32 and the primary windings of the transformers 37, 38 and convert the output signals from the comparators 31, 32 to suitable signals for transformation by using the inductive transformers 37, 38. These modulation circuits 35, 36 are, for example, pulse shapers which produce signal pulses in the case of level changes of the comparator output signals S31, S32 indicating that the upper threshold Vr1 has been exceeded or that the second threshold Vr2 has been undershot, and pass these to the primary windings of the transformers 37, 38. On the secondary side, detector circuits 39, 40 are connected to the transformers and compare secondary voltages from the transformers 37, 38 with reference voltages. These reference voltages are matched to the signal pulses produced by the pulse shapers 35, 36 such that, when a signal pulse is transformed via one of the transformers 37, 38, the voltage on the respective secondary coil of this transformer 37, 38 exceeds the value of the respective reference voltage. In the example, the detector circuits 31, 40 respectively include a reference voltage source 391, 401 and a comparator 392, 402. The switch-off signals RS11, RS12 are produced at the outputs of these comparators 392, 402. If, for example, a secondary voltage from the first transformer 37 exceeds the value of the first reference voltage V391 as a consequence of a transmitted signal pulse, then the first switch-off signal RS11 in the illustrated example assumes a high level in order to switch off the first switch T11, in the manner which has already been explained above. In a corresponding manner, the second switch-off signal S12 assumes a high level when the secondary voltage from the second transformer 38 falls below the value of the second reference voltage V401 as a consequence of a transformed signal pulse, as a result of which the second switch T12 in the half bridge is switched off.

In the previously explained method and the previously explained lamp ballast, information is required about the current I1 flowing through the resonant circuit throughout the entire drive period of the resonant circuit in order to switch the first and the second switch T11, T12 off prematurely in the event of incipient saturation of the resonant circuit inductance. In this method that has been explained, balanced operation of the half bridge is achieved, that is to say both the time for which the first switch T11 is switched on and the time for which the second switch T12 is switched on are shortened in the event of incipient saturation.

A method in which information is required about the current I1 flowing through the resonant circuit only during a part of the drive period and which nevertheless results in balanced operation of the half bridge T11, T12 in the event of incipient saturation of the resonant circuit inductance, as well as a lamp ballast which carries out a method such as this, will be explained in the following text with reference to FIGS. 9 and 10.

Figure 9:
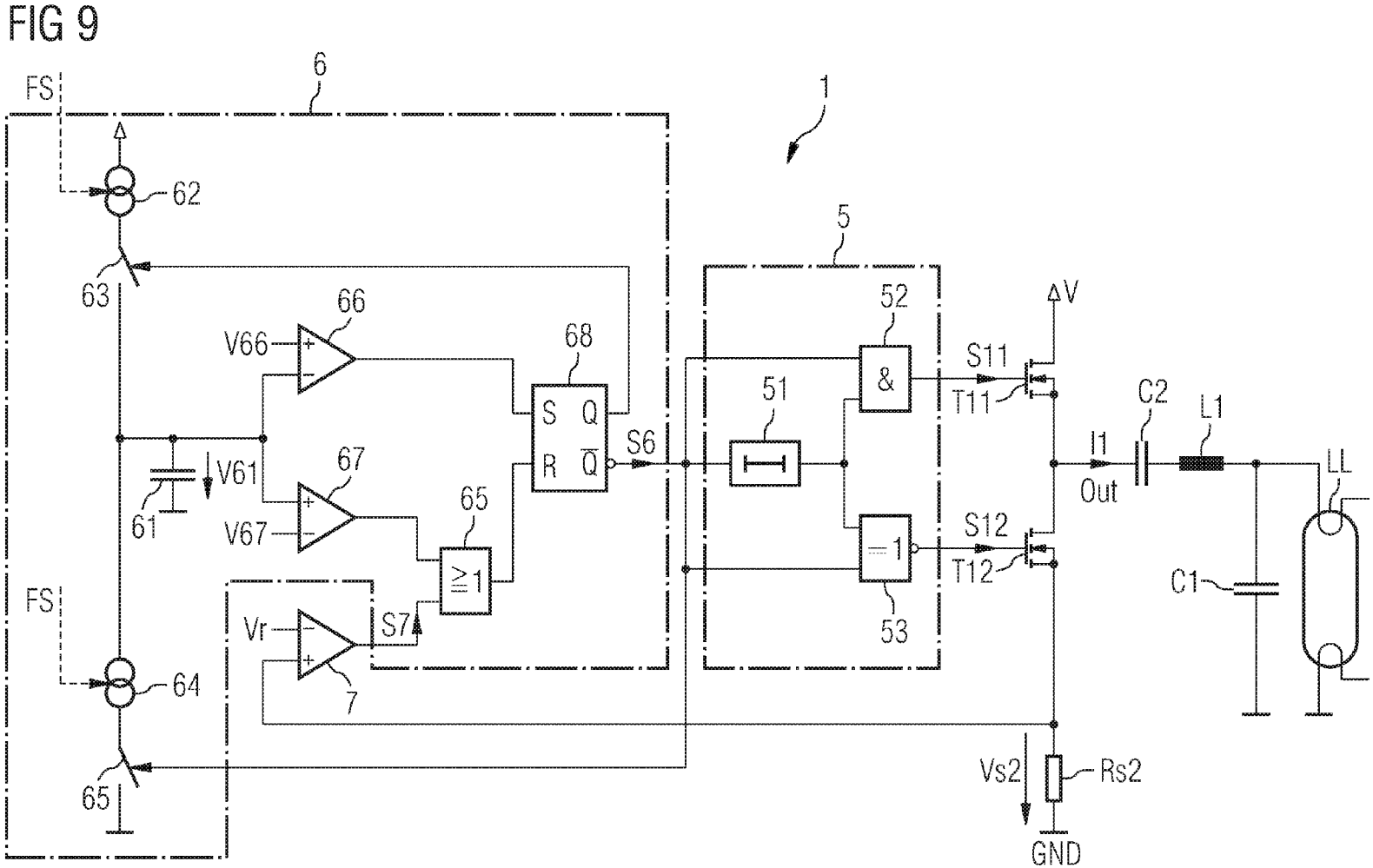
FIG. 9 illustrates an exemplary embodiment of a lamp ballast in which the current through the series resonant circuit is evaluated only at times, and in which the times for which the first and second switches are switched on are set to be at least approximately balanced, depending on this current.
Figure 10:
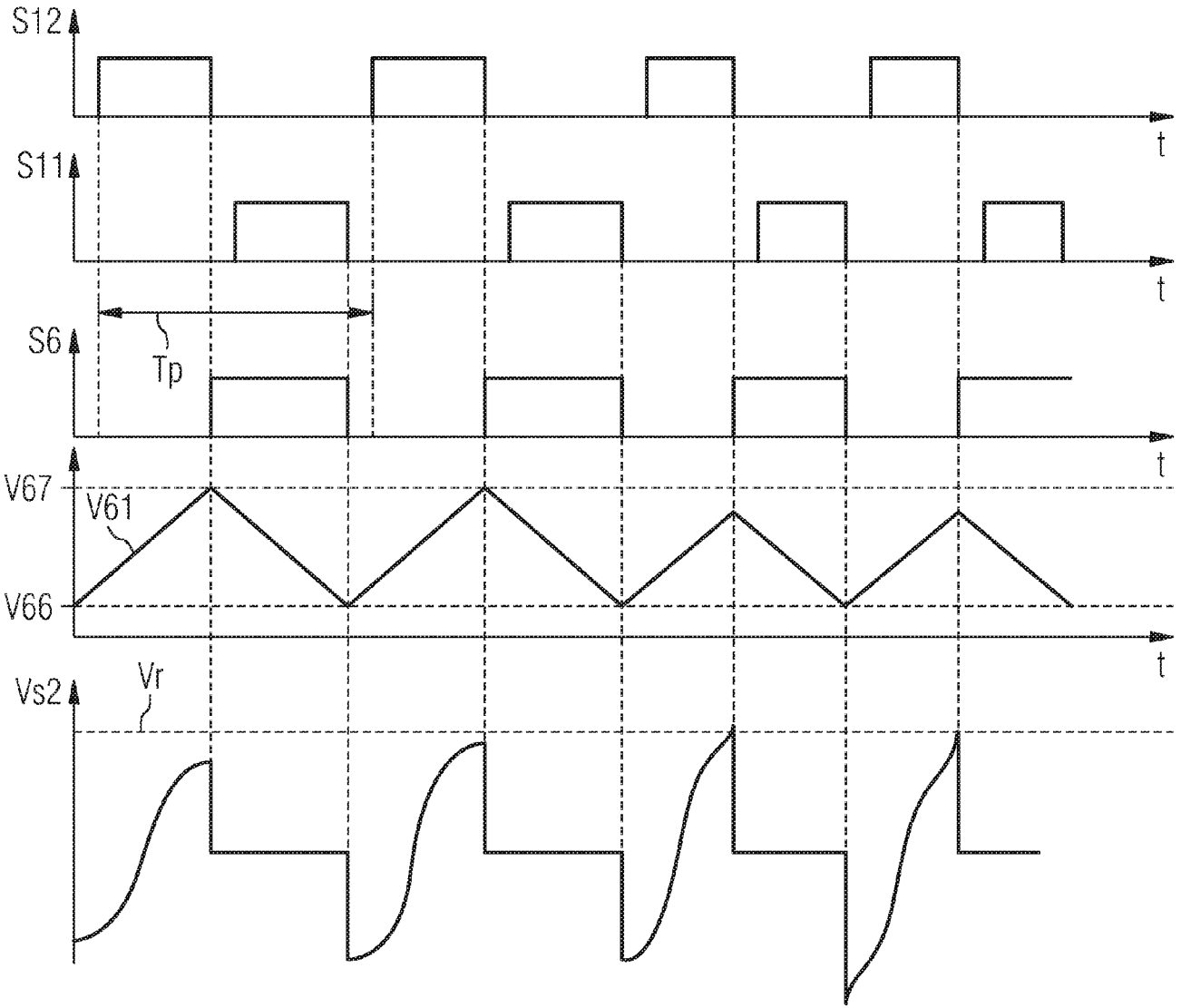
FIG. 10 illustrates the method of operation of the ballast of FIG. 9, on the basis of timing diagrams.

The lamp ballast illustrated in FIG. 9 includes a half bridge T11, T12 and a series resonant circuit L1, C1 which is connected to an output OUT of the half bridge T11, T12 and to which a fluorescent lamp LL can be connected during operation of the lamp ballast. A drive circuit for producing drive signals S11, S12 for the switches T11, T12 in the half bridge has an oscillator 6 in order to produce an oscillator signal S6, and a dead-time element 5, connected downstream from the oscillator 6. This dead-time element 5 may, for example, be provided in a manner corresponding to the dead-time element that has been explained with reference to FIG. 5, so that reference is made to the description relating to FIG. 5 with regard to the design and method of operation of this dead-time element 5.

The illustrated oscillator 6 produces a clock signal S6 which alternately assumes a high level and a low level.

For this purpose, this oscillator includes a capacitive energy storage element V61, one of whose connections is connected via a series circuit including a first current source 62 and a first switch 63 to an upper supply potential or a positive supply potential, and via a series circuit including a second current source 64 and a second switch 65 to a second supply potential, or reference ground potential. This upper supply potential may in this case in particular be less than an upper supply potential for the half bridge T11, T12.

In the example, a second connection of this capacitive energy storage element 61 is connected to the second supply potential. This capacitive energy storage element 61, for example a capacitor, is alternately charged via the first series circuit 62, 63 and discharged via the second series circuit 64, 65. A voltage V61 which is produced across the capacitive energy storage element 61 in this case has a triangular signal waveform, which is illustrated by way of example in FIG. 10. Alternate activation of the first and second series circuits for charging and discharging the energy storage element 61 takes place via a flipflop 68 which has a non-inverting output and an inverting output. The first switch 63 in the first series circuit is in this case operated via the non-inverting output of the flipflop 68, and the second switch 65 in the second series circuit is operated via the inverting output of this flipflop 68. For explanatory purposes, it is assumed that the switches 63, 65 are in each case switched on when the associated flipflop output signal is at a high level, and are switched off when the respective flipflop output signal is at a low level. Since a high level is in each case produced alternately at the outputs of the flipflop 68, this ensures that the series circuits are activated alternately.

In the case of the oscillator illustrated in FIG. 9, the clock signal S6 is produced at the inverting output of the flipflop 68.

This clock signal S6 therefore assumes a high level when the flipflop 68 is reset, and a low level when the flipflop is set. In the corresponding manner, the first switch T11 is switched on once a dead time, which is predetermined by the dead-time circuit 5 has passed after resetting the flipflop 68, and is switched off immediately when the flipflop 68 is set. "Immediately" in this context means that there is no minimum delay time between the setting of the flipflop 68 and the first switch T11 being switched off, but delays occur only as a result of unavoidable signal delay times and as a consequence of switching delays in the first switch T11. The second switch T12 is switched on once the dead time has passed after setting the flipflop 68, and is switched off immediately when the flipflop 68 is reset.

The flipflop 68 is set and reset as a function of a comparison of the capacitor voltage V61 with an upper and a lower threshold value V67, V66. The flipflop 68 is reset in the illustrated circuit when the capacitor voltage V61 rises to the upper threshold value V67 when the first switch 63 is switched on, and is set when the capacitor voltage V61 falls to the lower threshold value V66 when the second switch 65 is switched on. The capacitor voltage V61 and the lower threshold value V66 are for this purpose supplied to a first comparator 66, which has an output which is connected to the set input of the flip-flop 68. In a corresponding manner, the capacitor voltage V61 and the upper threshold value V67 are supplied to a second comparator 67, whose output is supplied to the reset input R of the flipflop 68 via an OR gate 69, which is still to be explained. The method of operation of this oscillator arrangement 6 will be explained briefly in the following text:

When the flipflop 68 is set, then the first series circuit is activated, as a result of which the capacitor voltage V61 rises. When the rising capacitor voltage V61 during this process reaches the upper threshold value V67, then the flipflop 68 is reset, as a result of which the first series circuit 62, 63 is deactivated, and the second series circuit 64, 65 is activated. The capacitor 61 is then discharged, as a result of which the capacitor voltage V61 falls. When the capacitor voltage V61 during this process reaches the lower threshold value V66, then the flipflop 68 is reset, and in consequence the upper series circuit 62, 63 is activated, and the lower series circuit 64, 65 is deactivated. As is illustrated in FIG. 10, the clock signal S6 in the illustrated example assumes a high level when the capacitor voltage V61 falls, and a low level when the capacitor voltage rises.

In order to detect incipient saturation of the resonant circuit inductance L1, the illustrated lamp ballast has a measurement resistor Rs2 which is connected in series with the switches T11, T12 in the half bridge and, in the illustrated example, between the second switch T12 and the lower supply potential or reference ground potential. As context, it should be noted that an upper supply potential for the drive circuit 1 and an upper supply potential for the half bridge are different. While the upper supply potential for the half bridge may assume values of up to several hundred volts, the upper supply potential for the drive circuit 1 is, for example, in the region of a few volts. The lower supply potential for the half bridge may in contrast correspond to the lower supply potential of the drive circuit 1 and may, for example, be a reference ground potential, in particular ground.

A current I1 is measured by the resonant circuit in the case of the illustrated lamp ballast only during a part of the drive period, specifically when the second switch T12 is switched on and when a freewheeling diode which is integrated in the second switch T12 or an external freewheeling diode (not illustrated) is forward-biased. A profile over time of a measurement voltage Vs2 which is produced across this measurement resistor Rs2 is illustrated in FIG. 10, and is dependent on the clock signal S6 and the drive signals S11, S12 which result from it. Once the first switch T11 is switched off until the second switch T12 is switched off, this measurement signal Vs2 follows the current I1 through the resonant circuit, and is otherwise zero.

In order to detect incipient saturation of the resonant circuit inductance L1, the measurement signal Vs2 which is produced across the measurement resistor Rs2 is compared with a reference value Vr. If this measurement signal Vs2 reaches the reference value Vr while the second semiconductor switch T12 is switched on, then incipient saturation of the resonant circuit inductance L1 is assumed, and the second switch T12 is switched off independently of the state of charge of the capacitor 61. A comparator arrangement 7 is provided in order to compare the measurement voltage Vs2 with the reference value Vr and, for example, is in the form of a comparator. An output signal from this comparator is supplied via the OR gate 69 of the oscillator 6 to the reset input of the flipflop 68. The comparator 7 resets the flipflop 68 when the measurement voltage Vs2 resets the reference value Vr while the second switch T12 is switched on, as a result of which the second switch T12 is immediately switched off via the inverting output of the flipflop 68 and the NOR gate 53 in the dead-time circuit. If the flipflop 68 is reset even before the triangular-waveform voltage signal V61 reaches the upper threshold value V67 of the oscillator circuit 6, not only is the time duration of a low level of the clock signal S6 shortened, and therefore the time duration for which the second switch T12 is switched on, but also a subsequent discharge time for the capacitor to reach the lower threshold value V66, thus shortening a subsequent time period of a high level of the clock signal S6, and therefore the time duration for which the first switch T11 is switched on. In the oscillator circuit 6 illustrated in FIG. 9, the capacitor 61 in the oscillator circuit 6 carries out two functions in the lamp ballast illustrated in FIG. 9. Firstly, the capacitor 61 in conjunction with the series circuits governs the frequency of the clock signal S6 during normal operation, in which case this frequency can be set, for example, via the currents supplied by the current sources 62, 64. In this case, the two current sources 62, 64 may be implemented, in particular, such that they produce identical currents, thus resulting in a balanced clock signal, that is to say a clock signal with high levels and low levels of equal duration during normal operation.

In the illustrated oscillator 6, the capacitor 61 is also used for time measurement, specifically in order to determine a time period between the first switch S11 being switched off and incipient saturation of the resonant circuit inductance L2. This time period is proportional to the difference between the capacitor voltage V61 at the time of switching off as a result of saturation and the lower threshold value V66. On the assumption that the triangular waveform signal is produced to be balanced, the time required for the capacitor 61 to discharge from this value in the event of switching off as a result of saturation down to the lower threshold value V66 corresponds precisely to the previous rise period, thus resulting in the half-bridge switches T11, T12 being operated in a balanced form also when switching off as a result of saturation, that is to say the time for which the second switch T12 is switched on before switching off as a result of saturation corresponds at least approximately to the time for which the first switch T11 is switched on during the subsequent period in which this first switch T11 is switched on.

It should be noted that the circuit explained with reference to FIG. 9 relating to the implementation of the drive method illustrated in FIG. 10 should be regarded just as an example. In particular, it is possible to determine the time period between the first switch being switched off and incipient saturation of the resonant circuit inductance L1, to store this and to use it for subsequently switching the first switch T11 on, in any other desired manner. In particular, it is possible to produce the clock signal using digital means. For this purpose, for example, the capacitor could be in the form of a counter which could be incremented and decremented, and the signal generators could be in the form of clock generators which can be activated in order to increment and decrement this counter.

When using a triangular waveform signal to produce the clock signal S6 and thus to produce the drive signals S11, S12, the half bridge T11, T12 can additionally be operated in a balanced form in the event of incipient saturation of the resonant circuit inductance by reducing the upper threshold value V67, at least for a predetermined time period, when incipient saturation occurs. This results in an increase in the frequency of the clock signal S6, and the times for which the first and second switches T11, T12 are switched on are shortened.

Figure 11:
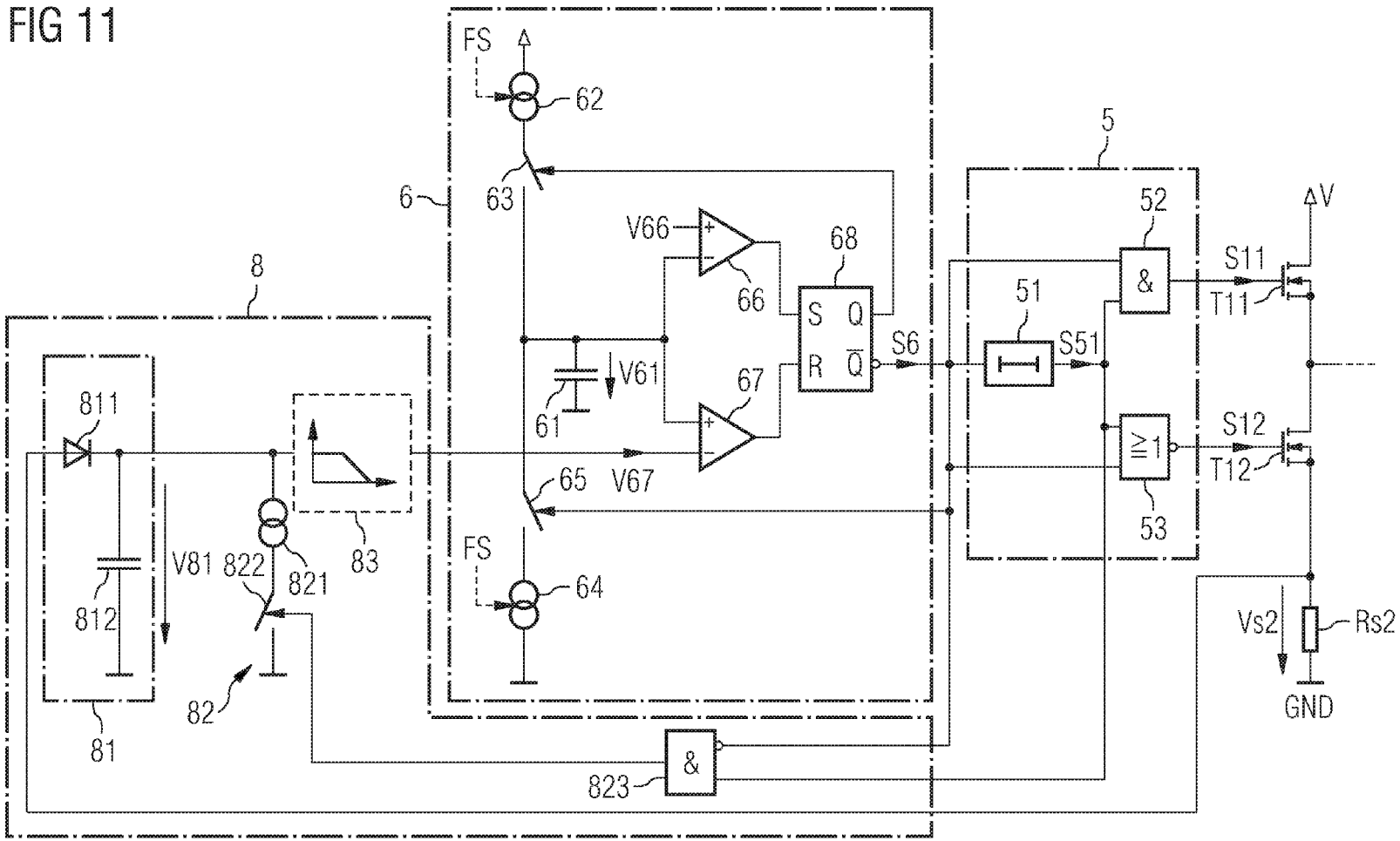
FIG. 11 illustrates one exemplary embodiment of a lamp ballast, in which the current through the series resonant circuit is evaluated only at times, and in which the times for which the first and second switches are switched on are set to be at least approximately balanced, depending on a peak value of this current.

FIG. 11 illustrates a lamp ballast with a functionality such as this, but in which only the half bridge T11, T12 and the drive circuit 1 are illustrated, for clarity reasons. An oscillator 6 for the drive circuit 1 may in this case be in a corresponding form to the oscillator in FIG. 9, with the difference that the flipflop is reset, and the second switch 68 is therefore switched off, exclusively as a function of the output signal from the comparator which compares the capacitor voltage V61 with the upper threshold value V67. In the case of this oscillator 6, the capacitor voltage V61 is alternately charged from the lower threshold value V66 to the upper threshold value V67, and discharged from the upper threshold value V67 down to the lower threshold value V66. In this example, a time to charge the capacitor V61 governs the time duration of a low level of the clock signal, while the time to discharge it governs the time duration of a high level of this clock signal. The frequency of this clock signal S6 is in this case dependent on the flank gradients of the triangular waveform signal, and therefore on the amplitudes of the currents produced by the current sources 62, 64. By way of example, the frequency signal FS can be supplied to the current sources 62, 64 in order to set the clock frequency.

The frequency of the clock signal S6 is also dependent on the difference between the upper threshold value V67 and the lower threshold value V66. In the lamp ballast illustrated in FIG. 11, this difference can be kept at least approximately constant by keeping the resonant circuit inductance L1 away from saturation, and this difference can be reduced by reducing the upper threshold value V67 when incipient saturation of the resonant circuit inductance L1 is detected. The illustrated ballast has a threshold value generator 8 which is designed to produce the upper threshold value V67 as a function of the resonant circuit current in such a way that this current decreases when a peak value of the current rises above a predetermined threshold value. In particular, this threshold value can be chosen such that incipient saturation of the resonant circuit inductance is assumed when the resonant circuit current reaches the threshold value. In this context, it should be noted that the clock frequency of the clock signal S6 may, of course, also be raised by raising or increasing the lower threshold value V66 or by reducing the upper threshold value V67 and increasing the lower threshold value V66.

In the illustrated example, the threshold value signal generator 8 includes a peak value detector 81 to which the current measurement signal Vs2, which is proportional to the resonant circuit current, is supplied, and which produces an output signal V81 which is dependent on the peak value of the measurement signal Vs2. In the illustrated example, the peak value detector 81 has a diode 811 and a capacitive energy storage element 812, which is connected downstream from the diode and, for example, is in the form of a capacitor. An output signal V81 from the peak value detector is in this case made available across the capacitor 812. If the measurement signal Vs2 rises over time, the output signal V81 from the peak value detector follows this measurement signal. If the measurement signal Vs2 falls over time again, starting from a maximum value, then the output voltage V81 remains at this maximum value because of the diode 811, which prevents discharging of the capacitive energy storage element 812. In the peak value production circuit 8 illustrated in FIG. 11, the maximum value or peak value of the measurement signal Vs2 must be redetermined during each drive period of the half bridge. For this purpose, the capacitor 812 of the peak value detector 81 is partially discharged through a discharge circuit 82 during each drive period. By way of example, the discharge circuit 82 has a current source 821 which is connected in parallel with the capacitor 812, can be activated and deactivated, and discharges the capacitor 812 when in the activated state. By way of example, the current source is activated via a switch 822 connected in series with the current source 821. In the illustrated threshold value production circuit 8, the current source 821 can in each case be discharged during the dead time after the first switch T11 has been switched on and before the second switch T12 is switched on. In this case, the current source 821 is activated by an AND gate 823 which has an inverting input and a non-inverting input. In this case, the inverting input of this AND gate 823 is supplied with the clock signal S6, and the non-inverting input is supplied with the output signal S51 from the delay element 51 of the dead-time circuit 5. An output signal from this AND gate 823 assumes a high level, which activates the current source 821, whenever the clock signal S6 assumes a low level and the output signal from the delay element 51 assumes a high level. With reference to FIG. 6, a signal configuration such as this is produced during the dead time between the first switch T11 being switched on and the second switch T12 being switched on.

Figure 12:
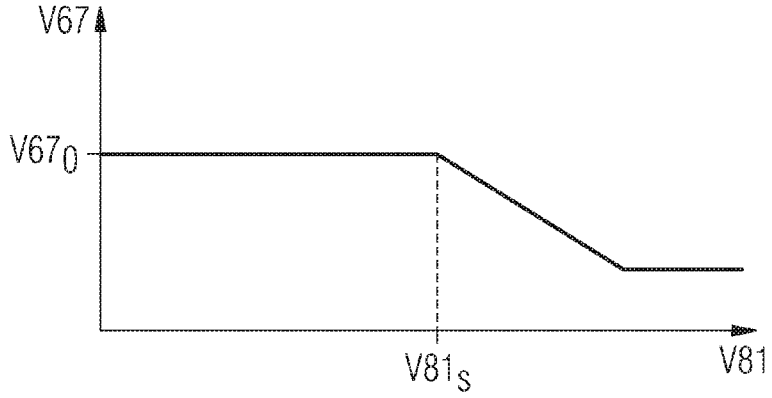
FIG. 12 illustrates, by way of example, the transfer function of an imaging or amplification unit provided in the lamp ballast illustrated in FIG. 11.

The output signal from the peak value detector V81 is supplied to an imaging unit 83 which, for example, is in the form of an amplifier with a non-linear transfer function and produces the upper threshold value V67 from this output signal V81. This imaging unit 83 has, for example, a transfer function as illustrated in FIG. 12, in which the upper threshold value V67 is illustrated as a function of the output signal V81, and therefore as a function of the peak value of the measurement signal Vs2. This imaging unit 83 produces the upper threshold value V67 in such a way that the upper threshold value V67 assumes a constant value $V67_0$ when the output signal V81 from the peak value detector 81 is less than a first threshold value $V81_s$. If the output signal exceeds this threshold value $V81_s$, then the upper threshold value V67 is decreased as the amplitude of the output signal V81 increases, in order in this way to reduce the clock period of the clock signal S6, and therefore the operating times of the first and second switches T11, T12.

The upper threshold value V67 may be produced by the imaging unit 83 in particular in such a way that it assumes a minimum value when the output signal V81 from the peak value detector 81 exceeds a further threshold value which is higher than the first threshold value $V81_s$, and in such a way that it remains at this minimum value if the peak value detector output signal decreases further.

The threshold value $V81_s$, may in this case be matched to the parameters of the series resonant circuit and to the measurement resistor Rs2 in such a way that incipient saturation of the resonant circuit inductance can be assumed when the measurement signal Vs2 reaches this threshold value $V81_s$. In the event of incipient saturation of the resonant circuit inductance, the times for which the first and second switches T11, T12 are switched on in the case of the lamp ballast illustrated in FIG. 11 are shortened in a balanced form.

In a further embodiment of the invention, the times for which the first and second switches are switched on can in this case be controlled as a function of the waveform of the current I1 of the series resonant circuit in such a way that the second switch T12 remains switched on for only a predetermined time period after a zero crossing of the resonant circuit current. The total time for which the second switch T12 is switched on in this case corresponds at least approximately to a subsequent time for which the first switch T11 is switched on, in order to operate the switches in a balanced form during a drive period.

Figure 13:
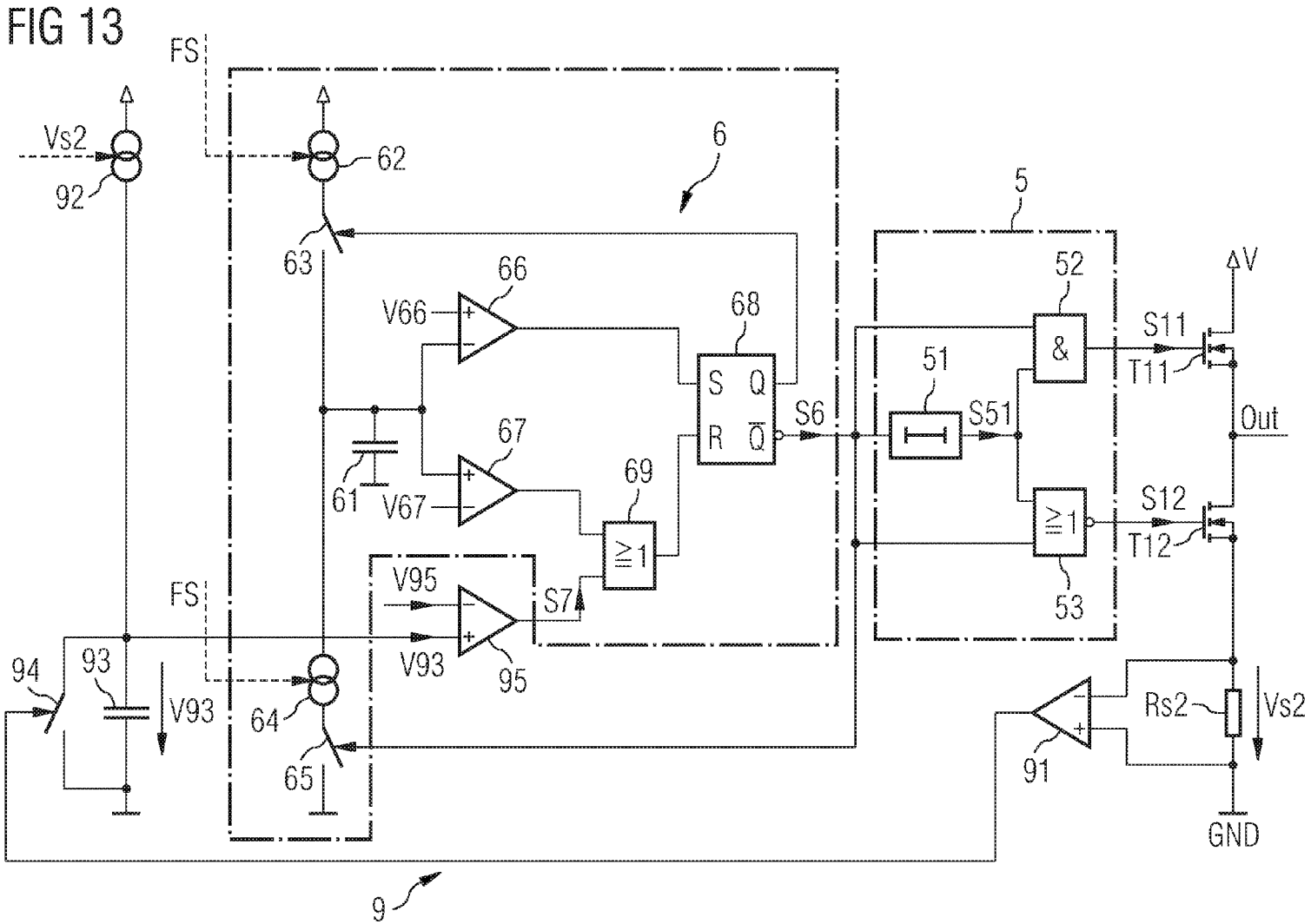
FIG. 13 illustrates a lamp ballast in which one of the switches in the half bridge remains switched on after a zero crossing of a resonant circuit current for a maximum of a predetermined time period.

A drive circuit which ensures that the half bridge T11, T12 is operated in this way is illustrated in FIG. 13. The illustrated drive circuit is based on the drive circuit explained with reference to FIG. 9 and has been modified from this drive circuit illustrated in FIG. 9 by prematurely resetting the flipflop 68 of the oscillator 6 by a time control circuit 9 in order to switch the second switch T12 off, which time control circuit 9 detects a zero crossing of the current measurement signal Vs2 and resets the flipflop 68 once a predetermined time period has passed after this zero crossing, in order to switch off the lower switch T12. This time control circuit 9 has a zero-crossing detector 91 which, for example, is in the form of a comparator whose inputs are connected to the measurement resistor Rs2. This zero-crossing detector 91 controls the time measurement arrangement 92, 93, 94, 95, which can be activated and deactivated and is connected via the OR gate 69 of the oscillator 6 to the reset input of the flipflop 68. The time measurement circuit has a series circuit including a current source 92 and a capacitor 93, as well as a comparator 95 to which a voltage V93, which is produced across the capacitor 93, and a comparison voltage V95 are supplied. The time measurement arrangement can be activated and deactivated via a switch 94, which is connected in parallel with the capacitor 93 and is operated by the zero-crossing detector 91.

Figure 14:
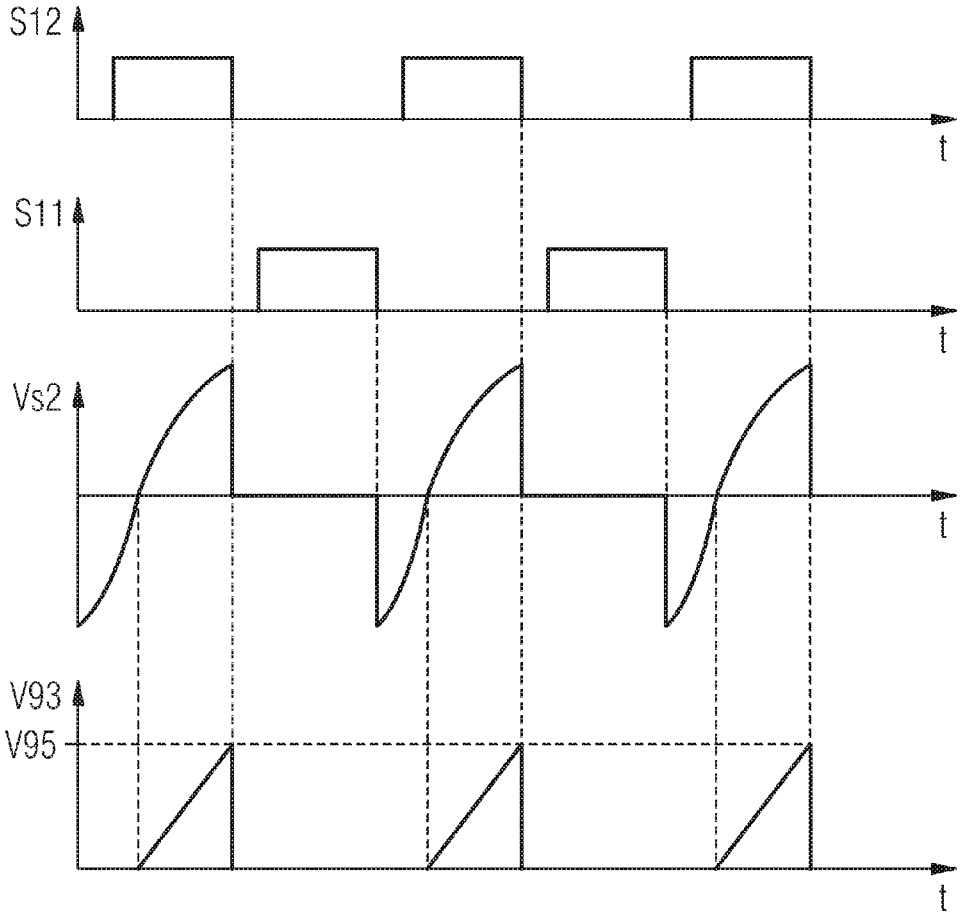
FIG. 14 illustrates the method of operation of the ballast illustrated in FIG. 13, on the basis of signal waveforms.

In the illustrated example, the time measurement arrangement is activated when the switch 94 is open. The zero-crossing detector 91 is in this case connected such that it opens the switch 94 after a zero crossing of the measurement voltage Vs2 when this measurement voltage assumes a value that is positive with respect to the reference ground potential GND, and therefore activates the time measurement arrangement. In this case, the capacitor 93 in the time measurement arrangement is charged by a current that is produced by the current source 92, as a result of which the capacitor voltage V93 rises linearly. When the capacitor voltage V93 reaches the comparison value V95 during this process, the flipflop 68 is thus reset, in order to switch off the lower switch T12. FIG. 14 illustrates the waveform over time of the voltage across the capacitor in the time measurement arrangement.

In a manner that has already been explained, the state of charge of the capacitor 61 in the oscillator 6 on resetting of the flipflop 68 represents a measure of the time for which the lower switch T12 is switched on. This state of charge governs the time for which the first switch T11 will subsequently be switched on, with this time for which the first switch T11 is switched on corresponding to the time for which the second switch T12 was previously switched on, assuming that the current sources 62, 64 in the oscillator 6 are designed to be identical. This ensures that the switches T11, T12 in the half bridge are operated in a balanced form.

In one embodiment of the invention, the time measurement arrangement can be modified, and the current supplied by the current source 92 can be set as a function of the current measurement value Vs2 (illustrated by dashed lines in FIG. 13). The voltage V93 across the capacitor 93 is then proportional to the integral of the current measurement value Vs2 and of the resonant circuit current after the zero crossing. The switch T12 is in this case switched off when this integral reaches a value which is predetermined by the comparison value V95. In this case, use is made of the fact that the resonant circuit current increases with increasing proximity to the resonant frequency. Evaluation of the integral of the resonant circuit current after the zero crossing and switching the second switch T12 off during this integral results in a predetermined value, preventing limiting of the resonant circuit current, and thus incipient saturation of the resonant circuit inductance.

Figure 15:
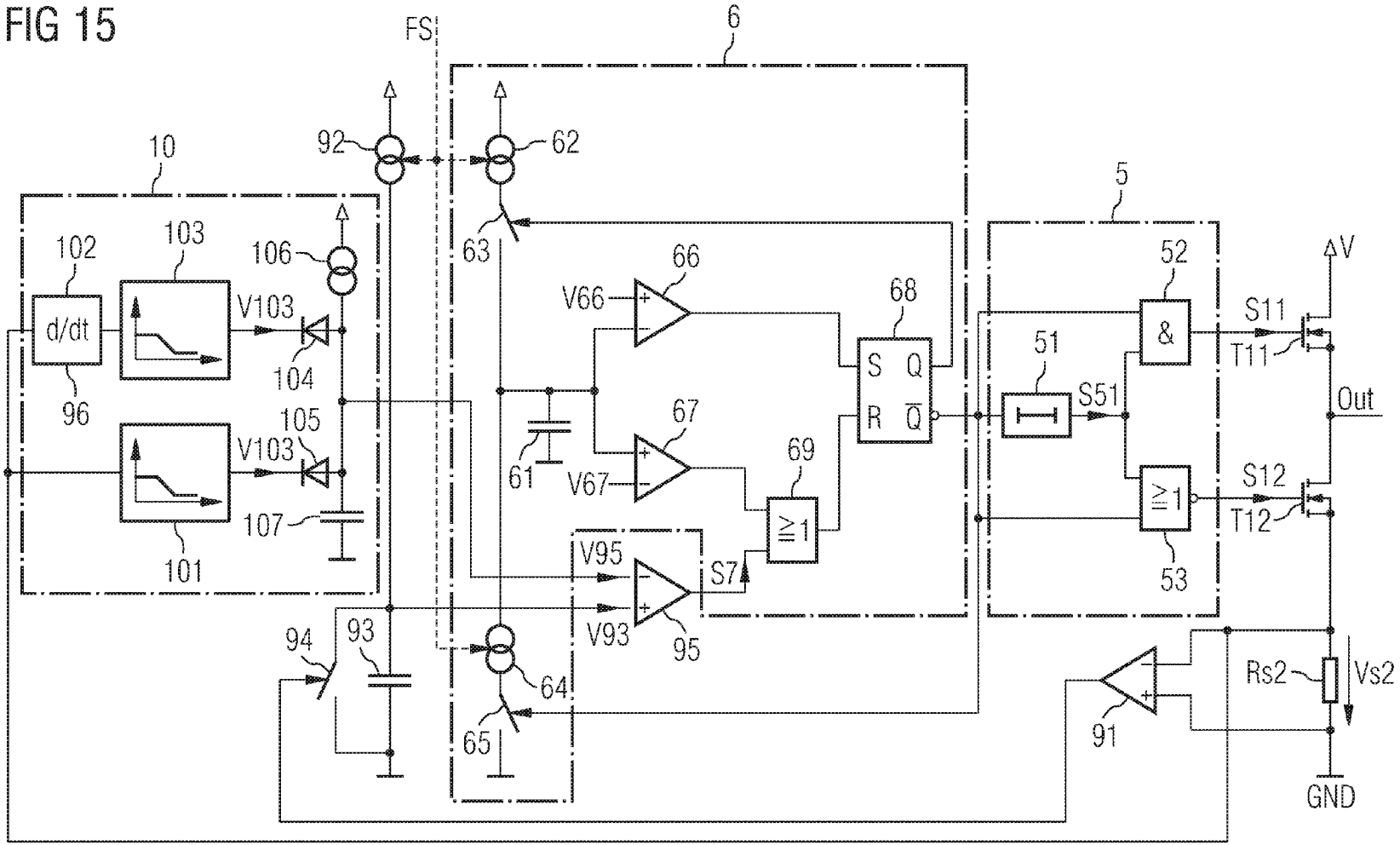
FIG. 15 illustrates the method of operation of a lamp ballast in which one of the switches remains switched on after a zero crossing of a resonant circuit current at most for a time period which is dependent on the amplitude of the resonant circuit current or a time derivative of the resonant circuit current.
Figure 16:
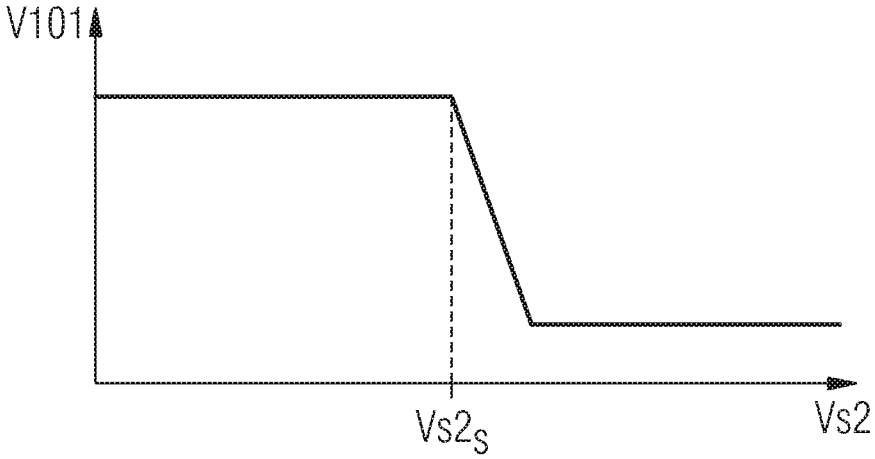
FIG. 16 illustrates, by way of example, the transfer ratio of an amplifier which is used in the ballast illustrated in FIG. 15.

FIG. 15 illustrates a further exemplary embodiment of a lamp ballast according to the invention, which has been modified from the lamp ballast illustrated in FIG. 13 by making the time period before the second switch T12 is switched off after a zero crossing of the current measurement signal Vs2 dependent on the value of the current measurement signal Vs2 and/or on a derivative of this current measurement value Vs2. The comparison threshold V95 of the comparator 95 which is coupled to the reset input R of the flipflop 68 is for this purpose produced as a function of the current measurement value Vs2, or of its time derivative, with the comparison value V95 being reduced in order to shorten the remaining time for which the second switch T12 is switched on after a zero crossing when the current measurement value Vs2 exceeds an upper threshold value, or when the derivative of this current measurement value Vs2 exceeds a threshold value. In the case of the lamp ballast illustrated in FIG. 15, the threshold value V95 is produced by a threshold value production circuit 10 to which the current measurement signal Vs2 is supplied and which produces the threshold value V95 as a function of this measurement signal Vs2. The threshold value production circuit 10 has a first imaging unit 101, to which the current measurement signal Vs2 is supplied and which produces an output signal which is dependent on this current measurement value Vs2. By way of example, FIG. 16 illustrates the characteristic of the transfer function of this imaging unit 101 which, by way of example, is in the form of a non-linear amplifier. An output signal V101 from this amplifier is at a first signal level in the illustrated example when the current measurement signal Vs2 is less than a predetermined threshold value $Vs2_s$. For values above this threshold value, the signal level of the output signal falls to a second signal level, which is lower than the first signal level. The output of this imaging unit 101 is followed by a peak value detector or minimum value detector, which stores the minimum value of the output signal V101 which has occurred prior to that. In the example, the peak value detector includes a diode 105 and a capacitor 107 connected to the diode. A voltage which is produced across this capacitor 107 in this case corresponds to the comparison signal V95, which is supplied to the comparator 95.

Optionally and furthermore, the comparison signal production circuit 10 has a differentiator 102 and a further imaging unit 103 connected downstream from the differentiator 102. An output signal from the differentiator 102 is in this case proportional to a derivative of the current measurement value Vs2 over time. An output signal from the second imaging unit 103 is dependent on this time derivative. Qualitatively, a transfer function of this second imaging unit 103 may correspond to the transfer function of the first imaging unit 101. The output of the imaging unit 103 is followed by a further peak value detector, which includes a further diode 104 and the capacitor 107. In this arrangement, the comparison value V95 corresponds to the respective lower of the output signals V101, V103 produced by the imaging units 101, 103 as a function of the current measurement signal Vs2 or its derivative. The lamp ballast illustrated in FIG. 15 makes use of the fact that the amplitude of the current measurement signal Vs2 and its rate of rise after the zero crossing rises sharply when the excitation frequency of the resonant circuit changes in the direction of the resonant frequency of the resonant circuit. Reducing the comparison value V95 as soon as the current measurement signal Vs2 or the rate of rise of this current measurement signal in each case exceed critical values results in the time for which the second switch T12 is switched on being shortened, and thus, following this, in the time for which the first switch T11 is switched on being shortened, when the excitation frequency of the resonant circuit approaches the resonant frequency too closely without the fluorescent lamp having already been started.

In the case of the illustrated ballast, a reduction in the comparison voltage V95 is first of all followed by an increase in the excitation frequency again, because the time for which the lower switch T12 is switched on after the zero crossing is shortened. In consequence, the oscillation amplitude of Vs2 decreases again. The capacitor 107 in the minimum-value detector is once again charged slowly via the current source 106 and thus slowly lengthens the time for which the switch is switched on again, thus resulting in the excitation frequency moving closer to the resonant frequency again. During this approach to the resonant frequency again, the time for which the lower half-bridge switch is switched on is controlled by the timer 9, while the frequency signal FS determines the times for which the switch is switched on, via the oscillator 6, on first approaching the resonant frequency.

Like the current source 82 in FIG. 11, by way of example, the current source 106 can also be implemented in such a way that it is activated only during the dead time after the upper switch T11 has been switched off, in order to charge the capacitor 107.

Figure 22:
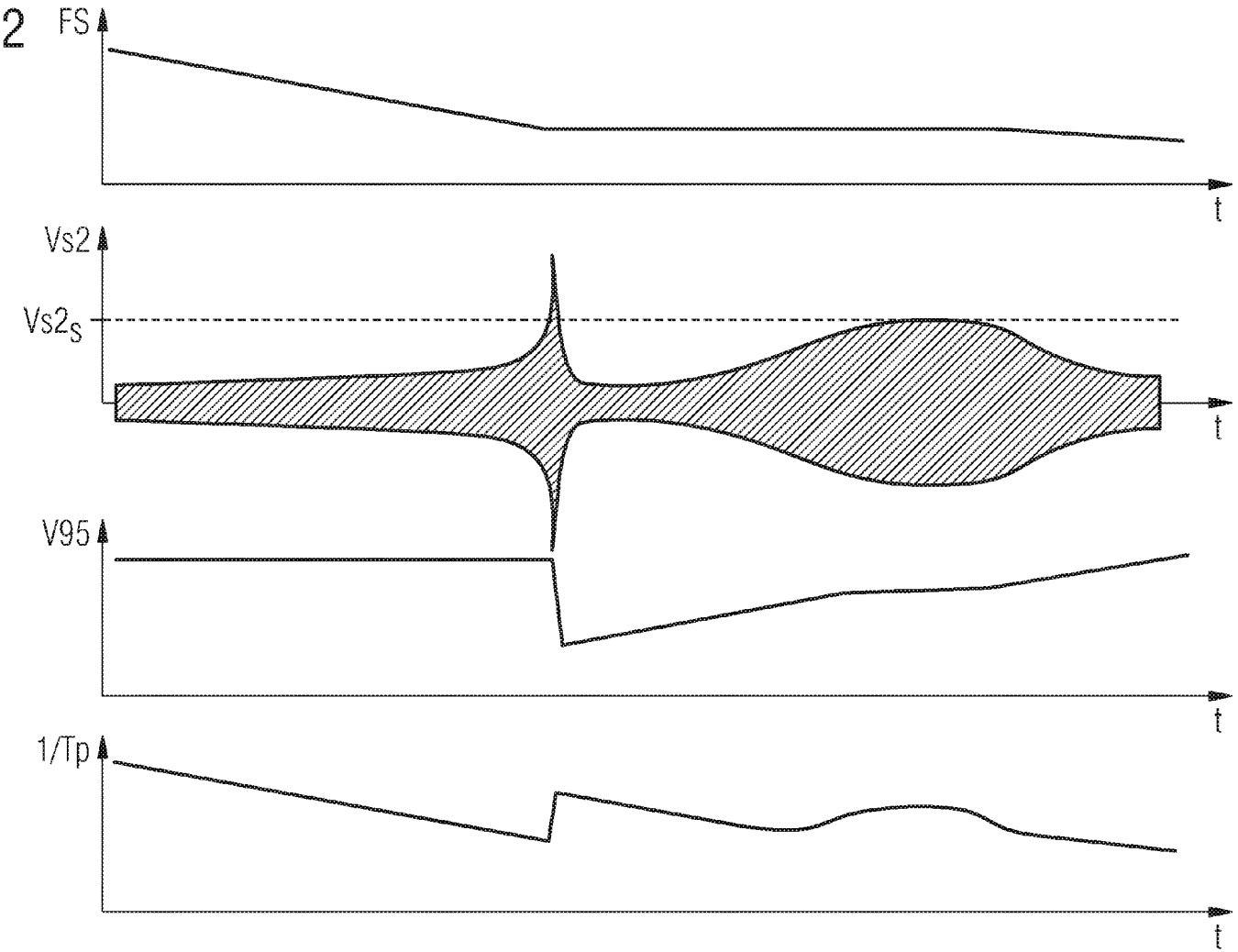
FIG. 22 illustrates the method of operation of a lamp ballast as illustrated in FIG. 15, on the basis of signal waveforms over time.

The method of operation of the ballast illustrated in FIG. 15 will be explained in the following text with reference to FIG. 22, which illustrates the frequency signal FS, the current measurement signal Vs2, the threshold value V95 and the excitation frequency f=1/Tp, in each case over time.

The illustration is based on the assumption that the capacitor 107 in the minimum-value detector is charged to a maximum value, which is governed by the voltage supply, as a result of which the comparison value V95 assumes its maximum value, and that the excitation frequency approaches, controlled by the resonant frequency. The time for which the switch is switched on after the current zero crossing is governed by the timer 9 and, overall, is longer than the time for which it is switched on when controlled by the oscillator 6 and, during this operating phase, the excitation frequency is initially dependent on the frequency signal FS, and not on the comparison signal V95.

As the excitation frequency approaches the resonant frequency, the coil current rises. As a result of the positive feedback effect that has been explained, the coil current also rises even further if the amplitude of the measurement signal has exceeded the threshold value $Vs2_s$. The illustration in FIG. 22 is based on the assumption that the frequency signal FS is not reduced any further once the current amplitude has exceeded the threshold value $Vs2_s$.

As soon as the current amplitude has exceeded the threshold value $Vs2_s$, the voltage V95 falls rapidly. The time for which the switch is switched on is governed by the timer 9 and is now considerably shorter than the time for which it is switched on when governed by the oscillator 6. The timer 9 therefore determines the time for which the switch is switched on, and this is dependent on the timing of the current zero crossing. Since the time for which it is switched on is now shortened again, the oscillation rapidly decays. V95 is now slowly charged again via the current source 106, and the time for which the switch is switched on is lengthened until the oscillation amplitude once again approaches the threshold $Vs2_s$. Because, this time, the time for which the switch is switched on is in each case produced from the current zero crossing, it is no longer possible to use the positive feedback effect. In the event of incipient coil saturation, the frequency may even rise again, even though the time for which the switch is switched on after the zero crossing has not been shortened, because the current zero crossing occurs earlier within a drive period.

When the lamp finally starts, the current amplitude decreases, the threshold $Vs2_s$ is no longer reached, V95 can be charged to the maximum value again and, finally, FS can also be reduced to the operating frequency of the lamp, again.

In a further embodiment of the invention, the excitation frequency can be increased by the frequency signal FS that is supplied to the oscillator 6 when the excitation frequency approaches the resonant frequency sufficiently close that the resonant circuit voltage starts to build-up in an uncontrolled form as a consequence of the positive feedback effect mentioned initially.

Figure 20:
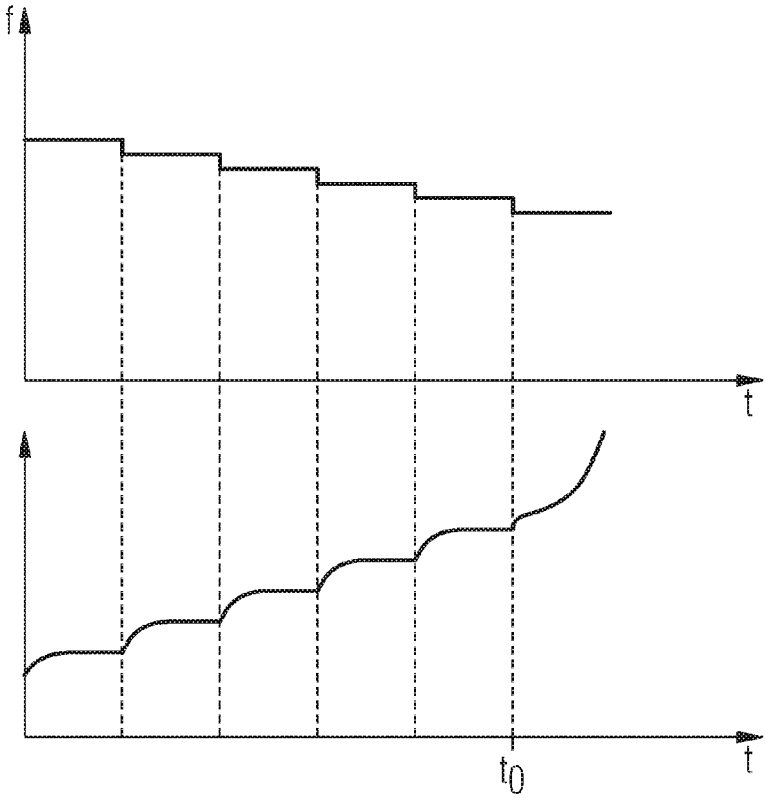
FIG. 20 illustrates, qualitatively, a waveform of the peak value of a resonant circuit current on reduction of the excitation frequency and without any additional measures to limit the current.
Figure 21:
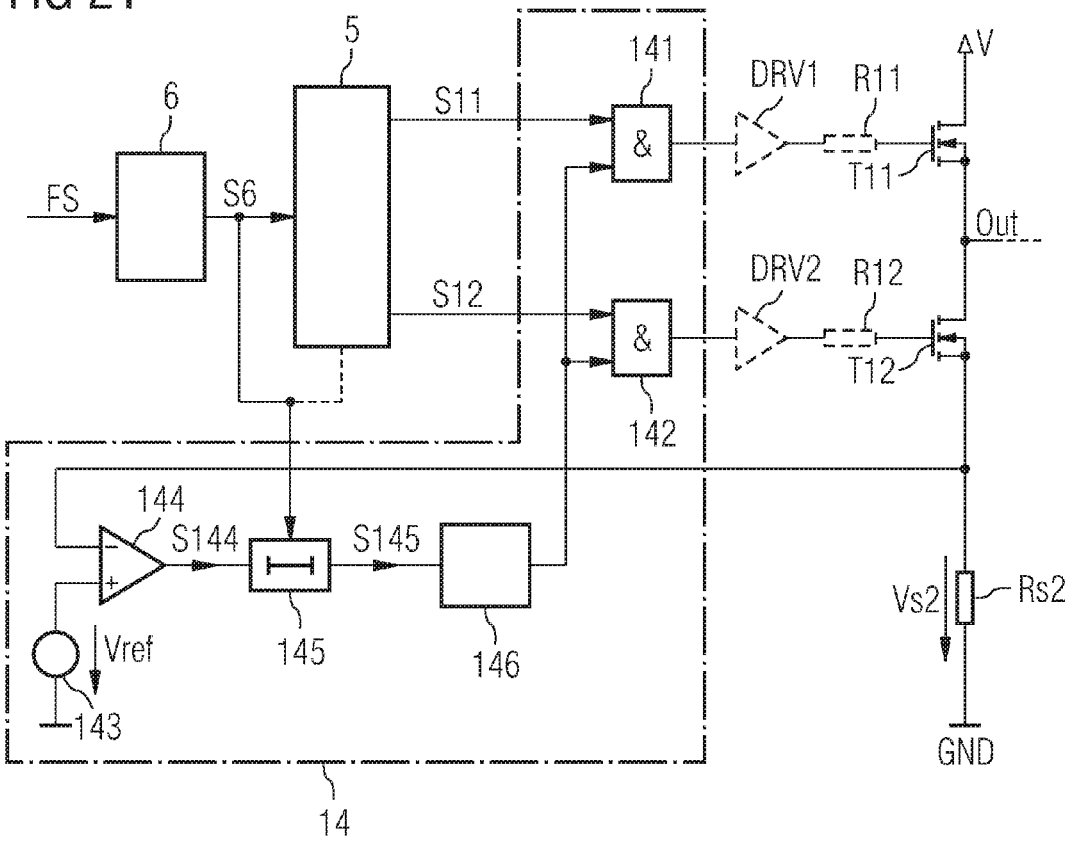
FIG. 21 illustrates a lamp ballast with a switching-off apparatus for switching off permanently on detection of an overcurrent through the half bridge.

In this context, reference will first of all be made to FIG. 20, which illustrates the waveform over time of an excitation frequency f which is decreased in steps. This frequency f may be set by using the frequency signal FS, in the manner that has already been described. A reduction in the excitation frequency results in an increase in a peak value of the resonant circuit current, and thus of the current measurement signal Vs2. A situation is illustrated after the time t0 in FIG. 20 in which a peak value $V_{max}$s2 rises rapidly with the excitation frequency remaining constant, indicating that the resonant circuit voltage is building up on the basis of the initially explained positive feedback effect. An increase in the excitation frequency in this case counteracts any further build-up of the resonant circuit voltage.

Figure 17:
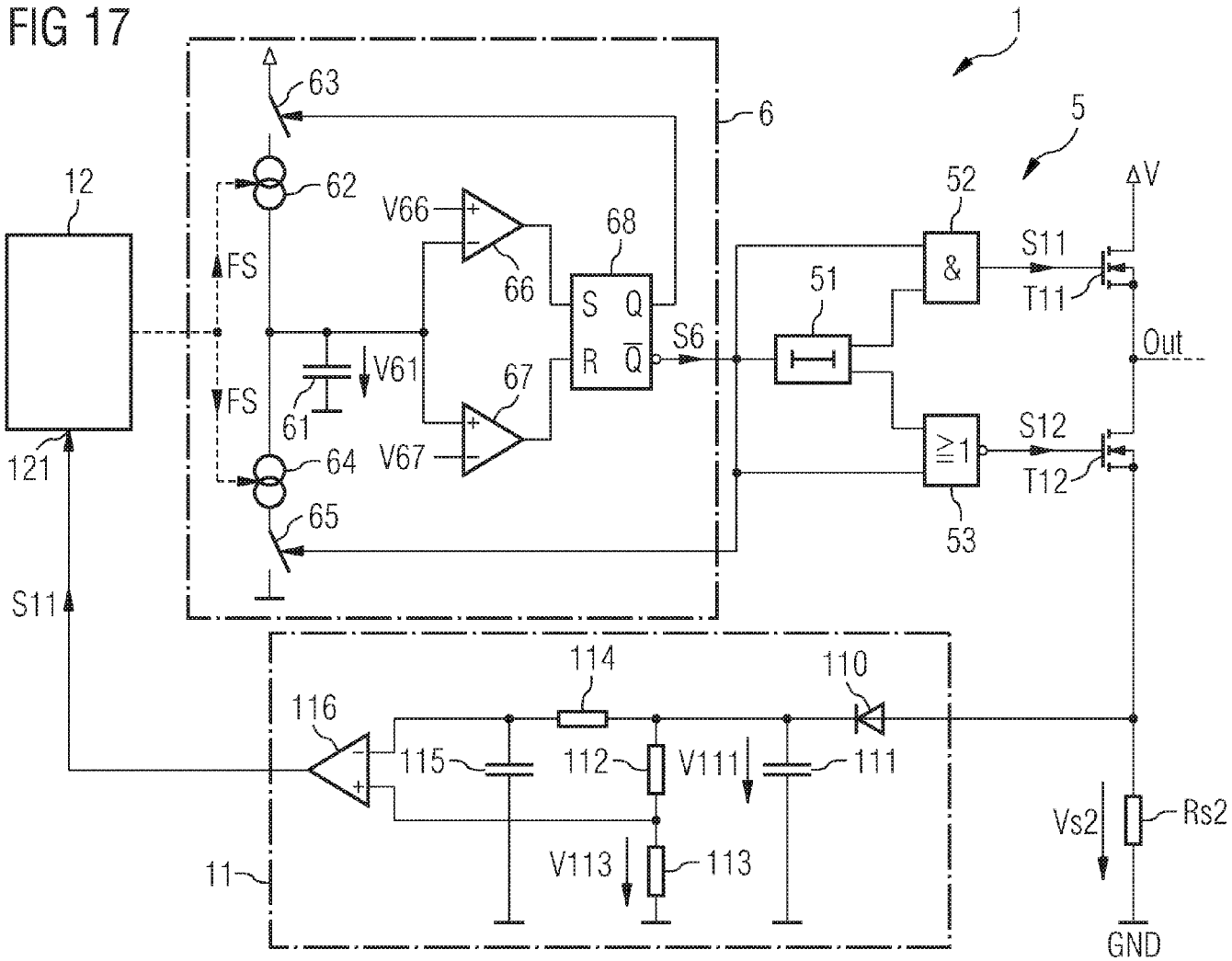
FIG. 17 illustrates a lamp ballast in which the excitation frequency for the series resonant circuit is set as a function of a time derivative of a peak value of the resonant circuit current.

A detail of a lamp ballast with a functionality such as this is illustrated in FIG. 17.

This lamp ballast includes an oscillator 6, to which the frequency signal FS is supplied. This frequency signal FS is used to set the frequency of a clock signal S6, which is produced by the oscillator 6 and operates the switches T11, T12 in the half bridge via a dead-time element 5. The design and method of operation of the oscillator 6 illustrated in FIG. 17 correspond to the design and method of operation of the oscillator which has already been explained with reference to FIG. 9. However, in the oscillator illustrated in FIG. 17, it is not possible to directly reset the flipflop 68 prematurely, and therefore to immediately end the time for which the second switch T12 is switched on, prematurely. In a corresponding manner, only the output of the comparator 67 in the oscillator 6 is supplied to the reset input of the flipflop 68.

In the case of the oscillator illustrated in FIG. 17, the frequency of the clock signal S6 is set by the current levels from the current sources 62, 64 in the triangular-waveform signal generator provided in the oscillator. The frequency signal FS for setting these current levels and therefore for setting the clock frequency of the clock signal S6 is provided by a control circuit 12. This control circuit 12 may, in particular, be in the form of a microcontroller which is able, by suitable programming, to reduce the clock frequency of the clock signal S6 in steps, and thus the excitation frequency of the resonant circuit in order to start the fluorescent lamp, starting from a predetermined initial value. This control circuit 12 has a control input 121 via which the control circuit 12 is supplied with a detector signal S11 from a detector circuit 11. This detector signal S11 contains information about the rate of change of the peak value of the resonant circuit current or of the current measurement signal Vs2. A rapid change in this peak value over time indicates that the resonant circuit voltage is building up. In this case, the control circuit 12 increases the excitation frequency at least temporarily for the frequency signal FS, in order to prevent the resonant circuit voltage from building up further, but while in principle allowing starting of the fluorescent lamp LL.

The detector circuit 11 is designed to compare the instantaneous peak value of the current measurement signal Vs2 with a previous peak value. If the difference between the instantaneous peak value and the previous peak value exceeds a predetermined threshold value, it is assumed that the resonant circuit voltage is building up, and the control signal S11 is set to a signal level by which the control circuit 12 increases the excitation frequency, at least temporarily. In the illustrated example, the detector circuit 11 has a peak value detector 110, 111, to which the current measurement signal Vs2 is supplied. An output signal V111 from the peak value detector, which in the example has a series circuit formed of a diode 110 and a capacitor 111, in this case corresponds to the instantaneous peak value of the current measurement signal Vs2 minus the voltage across the diode 110 when it is forward-biased, which is negligible for the present application. The output of the peak value detector is followed by a low-pass filter 114, 115, which low-pass-filters the output signal from the peak value detector. An output signal from this low-pass filter therefore represents information about the peak value of the current measurement signal Vs2 in the past. The output of the peak value detector 110, 111 is also connected to a voltage divider 112, 113, which produces an output signal V113, which presents a fraction of the instantaneous peak value, depending on a division ratio of the voltage divider 112, 113. In the illustrated detector circuit 11, the information which is produced at the output of the low-pass filter and relates to the peak value in the past which, for example, may correspond to the previous mean value of the peak value, is compared with the information, which is produced at the output of the voltage divider, for the instantaneous peak value. For this purpose, an output signal from the low-pass filter 114, 155 is supplied to a first input, in the example a negative input, of a comparator 116, and the output of the voltage divider 112, 113 is supplied to a second input, in the example the positive input of the comparator 116. If the output signal from the voltage divider 112, 113 is higher than the output signal from the low-pass filter 114, 115, then this means that a fraction of the instantaneous peak value is already higher than the mean peak value in the past. In this case, it is assumed that the resonant circuit voltage is building up. In this case, the comparator 116 assumes a high level in order to use the control signal S11 to cause the control circuit 12 to increase the excitation frequency, at least temporarily.

The sensitivity of the detector circuit 11 can be adjusted by using the division ratio of the voltage divider 112, 113. In this case, the detector becomes more sensitive the greater the division ratio of the voltage divider, that is to say the greater the ratio between the output voltage V113 from the voltage divider and the input voltage V111 to the voltage divider.

Alternatively, the control circuit 12 may be designed to produce a sudden phase change in the clock signal S6, and therefore in the excitation frequency, when the detector circuit 11 detects that the resonant circuit voltage is building up. A sudden phase change such as this can be achieved by considerably shortening one period of the excitation frequency. Shortening the period duration by ¼ corresponds, for example, to a sudden phase change of 90°, and shortening to half corresponds to a sudden phase change of 180°. Shortening the period duration in this way in order to achieve a sudden phase change can also be distributed over a number of successive periods, which are then shortened by corresponding elementary amounts, which in total result in the desired overall shortening.

Figure 18:
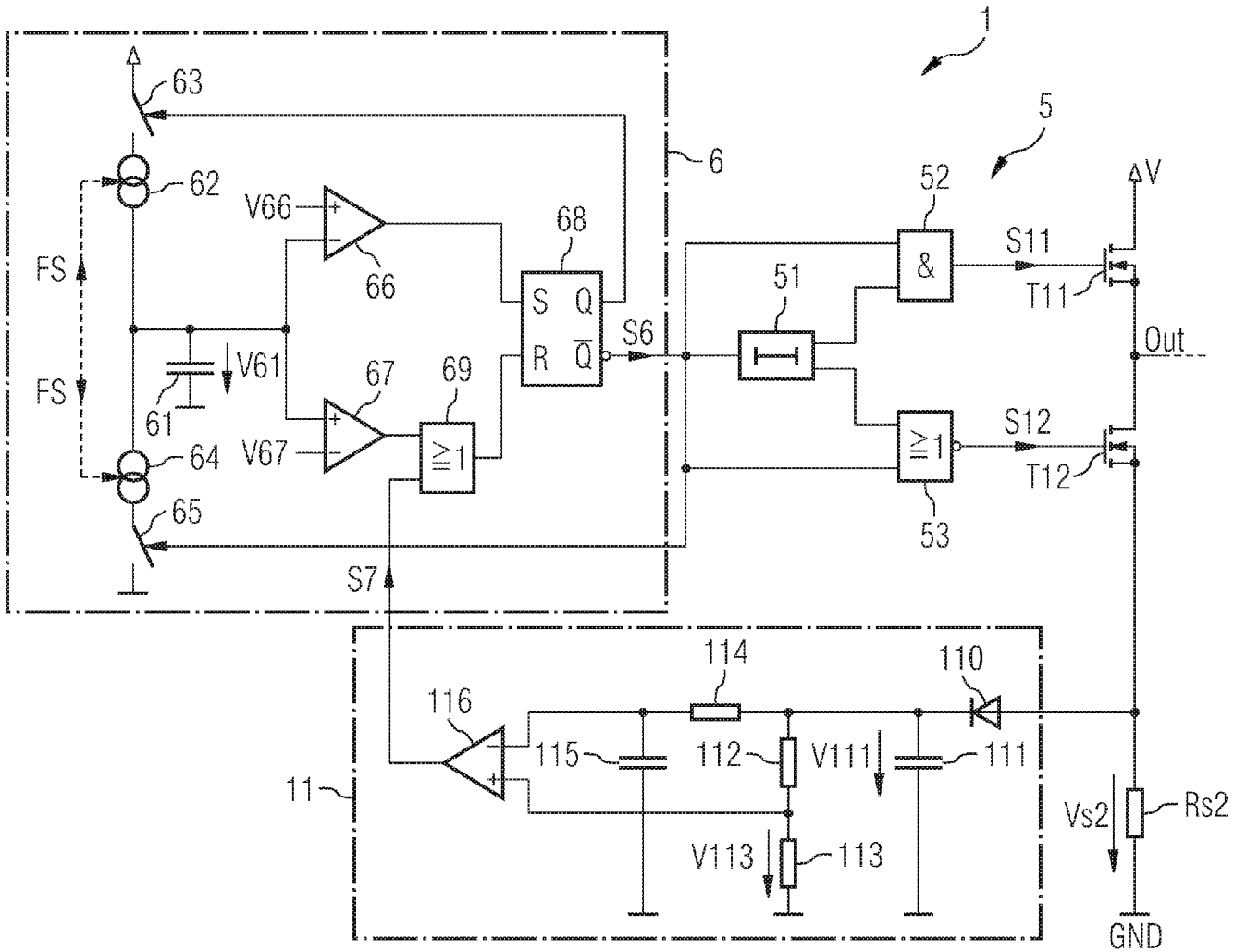
FIG. 18 illustrates a lamp ballast in which the times for which the switches in the half bridge are switched on are set to be balanced, as a function of a rate of change of a peak value of the resonant circuit current.

FIG. 18 illustrates a variant of the lamp ballast illustrated in FIG. 17. In this variant, the detector circuit 11 uses an OR gate 69, which has already been explained with reference to FIG. 9, in the oscillator 6 to directly operate the reset input of the flipflop 68 in order to immediately limit the time for which the second switch T12 is switched on when it is detected that the resonant circuit voltage is building up. This shortened time for which the second switch T12 is switched on has a direct effect on the subsequent time for which the first switch T11 is switched on, because of the explained design of the oscillator 6.

Figure 19:
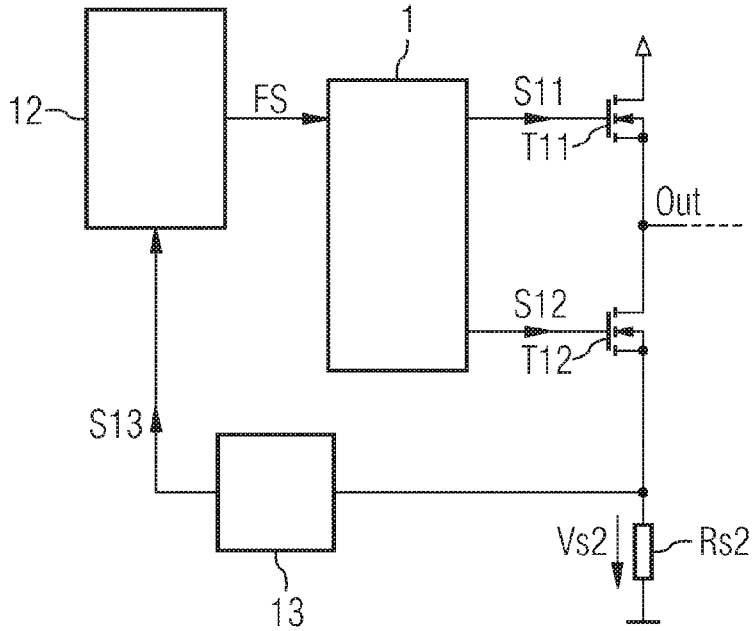
FIG. 19 illustrates a lamp ballast in which the excitation frequency for the resonant circuit is reduced as a function of a peak value of the resonant circuit current, a sudden phase change is produced in the excitation frequency, or the ballast is switched off.

In a further embodiment of the invention, the excitation frequency can be set as a function of a peak value of the current measurement signal Vs2. FIG. 19 illustrates a detail of a lamp ballast with a functionality such as this.

This lamp ballast includes a half bridge with two switches T11, T12, which are operated by a drive circuit 1. For this purpose, this drive circuit 1 is designed to operate the switches T11, T12 clocked at a frequency which is predetermined by a frequency signal FS. This drive circuit 1 may, for example, be implemented in a corresponding manner to the drive circuit 1 which is illustrated in FIG. 18 and has an oscillator 6 and a dead-time element 5.

Furthermore, the lamp ballast has a peak value detector 13 to which the current measurement signal Vs2 is supplied, and which produces an output signal S13 which represents the instantaneous peak value of the current measurement signal Vs2, and therefore the peak value of the instantaneous resonant circuit current I1. This peak value signal S13 is supplied to a control circuit 12, which produces the frequency signal FS in order to set the excitation frequency, as a function of this peak value signal S13. By way of example, the control circuit 12 is in the form of a microcontroller, which reduces the excitation frequency for starting a fluorescent lamp, starting from a predetermined initial value, over time, controlled by a suitable program, in order to increase the resonant circuit voltage in this way, and in order to start the fluorescent lamp. In addition, the control circuit is designed to compare the peak value S13 with three comparison values, which are referred to in the following text as V1, V2 and V3. In this case: V3>V2>V1. When the peak value S13 reaches or exceeds the lowest comparison value V1, then the control circuit 12 increases the excitation frequency, at least temporarily, by the frequency signal FS. If the peak value exceeds the highest comparison value V3, for example in the event of a lamp defect, then the lamp ballast is switched off, that is to say the switches T11, T12 are no longer operated. If the peak value S13 exceeds the central comparison value V2, which is between the lower comparison value V1 and the upper comparison value V3, then the control circuit 12 produces a sudden phase change in the excitation frequency, in which case the excitation frequency can also be reduced, when this central comparison value V2 is reached or exceeded. FIG. 20 illustrates one basic procedure for starting the lamp. FIG. 20 illustrates the waveform over time of a frequency f, which is decreased in steps, of the excitation frequency. This frequency f is set in the manner that has already been described by the frequency signal FS from the control circuit 12. A reduction in the excitation frequency results in an increase in the peak value of the resonant circuit current, and thus of the current measurement signal V2. This peak value of the current measurement signal V2 is represented by the output signal from the peak value detector 13. FIG. 20 illustrates a situation, after the time t0, in which the peak value S13 rises rapidly with the excitation frequency remaining constant, thus indicating that the resonant circuit voltage is building up as a result of the positive feedback effect explained initially. The already explained measures, specifically reducing the excitation frequency when the lower threshold value is exceeded, switching off the ballast when the upper threshold value is exceeded, and producing a sudden phase change in the excitation frequency, possibly while at the same time reducing the excitation frequency, counteract (in a manner which is not illustrated in any more detail) a rapid and uncontrolled rise in the resonant circuit current and/or in the resonant circuit voltage, as illustrated in FIG. 20.

A further aspect of the present invention relates to protection of the half-bridge circuit against overcurrent. Overcurrents such as these can lead to destruction of the switches T11, T12 in the half bridge, and therefore to damage to the lamp ballast. In this case, it is particularly dangerous for these overcurrents to flow for a relatively long time period. In contrast, short-term overcurrents can be tolerated.

According to one exemplary embodiment of the invention, provision is now made for the half-bridge current to be detected and evaluated in a lamp ballast. By way of example, the current measuring resistor Rs2, which is connected in series with the lower switch T12 in the half bridge, is suitable for detecting the half-bridge current. The current measurement signal Vs2 produced by this measurement resistor Rs2 represents a direct value for the current flowing through the half bridge at that time. This current measurement signal is supplied, for overcurrent detection purposes, to an overcurrent detector 143, 144 which, at one output, produces a switch-off signal for switching off the switches T11, T12 in the half bridge when an overcurrent is detected. The overcurrent detector in the example includes a comparator 144 to one of whose inputs the current measurement signal Vs2 is supplied, and a voltage source 143, which produces a comparison value Vref and is connected to a further input of the comparator 144. A switch-off signal S144 which is produced by the overcurrent detector is supplied to a fault memory 146, which stores the switch-off signal and results in the switches T11, T12 being switched off, via logic gates 141, 142 which are connected upstream of the drive connections of the switches T11, T12. These logic gates are AND gates in the illustrated example. The AND gate which is connected upstream of the first switch T11 is in this case supplied with the first drive signal S11 and with an output signal from the fault memory 146, and an AND gate which is connected upstream of the second switch T12 is supplied with the second drive signal S12 and with the output signal from the fault memory 146.

A delay element 145 is connected between the overcurrent comparator 144 and the fault memory 146, with the object of filtering out short-term non-hazardous overcurrent surges, such as those which can occur during switching processes, and to set the fault memory 146 only in the event of overcurrent events which last for longer than a predetermined time period, for example several hundred nanoseconds.

Because of the signal delays, for example in a dead-time element 5 or in driver circuits DRV1, DRV2 which are connected upstream of the drive connections of the half-bridge switches T11, T12, the first and second switches T11, T12 switch only after a time delay following a switch-off flank of the clock signal S6. An oscillator 6, which produces a clock signal S6 for the dead-time element, and the dead-time element 5 may be implemented, for example, in a corresponding manner to the oscillators and dead-time elements that have already been explained. With reference to FIG. 10, a falling flank of the clock signal S6 switches off the first switch T11, and a rising flank of the clock signal switches off the second switch T12. When the lamp ballast is being operated correctly, it can be assumed that the respective semiconductor switch will be switched off once the previously explained signal delay times have passed following the occurrence of a switch-off flank of the clock signal S6. These delay times can be further increased by bias resistors R11, R12, which are connected upstream of the drive connections of the switches T11, T12 in order to reduce the radiated electromagnetic emissions during the switching process. These signal delay times are normally, however, sufficiently short that it is possible for the half-bridge to tolerate an overcurrent flowing during the period of these signal delay times.

If a positive feedback effect occurs suddenly, resulting in major saturation of the resonant inductor L1, overcurrent surges likewise occur. The duration of these overcurrent surges depends on the one hand on the reaction time of a circuit for starting control. A reaction time such as this is, for example in the case of the drive circuit illustrated in FIG. 11, a time period which is required to charge the capacitor 812 in the peak value detector or, in the case of the drive circuit illustrated in FIG. 15, the time period which is required to discharge the capacitor 107 of the minimum-value detector via the amplifiers 101, 103. On the other hand, the duration of the overcurrent surges depends on the further signal delay time created by the dead-time element 5, the driver circuits DRV1, DRV2, the resistors R11, R12 and the semiconductor switches T11, T12. The total of all the delay times may be longer than the delay of the delay element 145. In this case, coil saturation would lead to an inadvertent overcurrent switch-off.

A delay element 145 with a switchable delay time is provided in order to avoid an inadvertent overcurrent switch-off. During the times in which the semiconductor switch T11 and the semiconductor switch T12 are switched on, the already mentioned delay time is set, for example of several hundred nanoseconds. After the time at which the oscillator 6 emits a flank which, following a signal delay time, leads to one of the two semiconductor switches T11, T12 being switched off, in particular the lower semiconductor switch T12, the delay elements temporarily has a longer delay time in the order of magnitude of 1 . . . 2 μs. The time period during which the delay time is lengthened may, for example, end when the respective other semiconductor switch is switched on, or after a fixed time period, which may correspond to the lengthened delay time.

This ensures that an overcurrent-dependent switch-off occurs only when the switch-off signal S144 is still at a switch-off level after the longer delay time has passed.

The exemplary embodiments explained so far have been based on the assumption that, if the time for which the second switch T12 is switched on is shorter than the time which the first switch T11 is switched on, with the latter being predetermined by the frequency signal FS, this then results in the same, shortened switched-on time. In this context, it should be noted that the time for which the first switch T11 is switched on need not necessarily correspond to the previous time for which the second switch T12 is switched on. In fact, the time for which the first switch T11 is switched on may be shortened in an unbalanced form with respect to the time for which the second switch T12 is switched on, so that the times for which the switches are switched on are between the time for which the second switch T12 is switched on and the switched-on time predetermined by the frequency signal FS.

Figure 23:
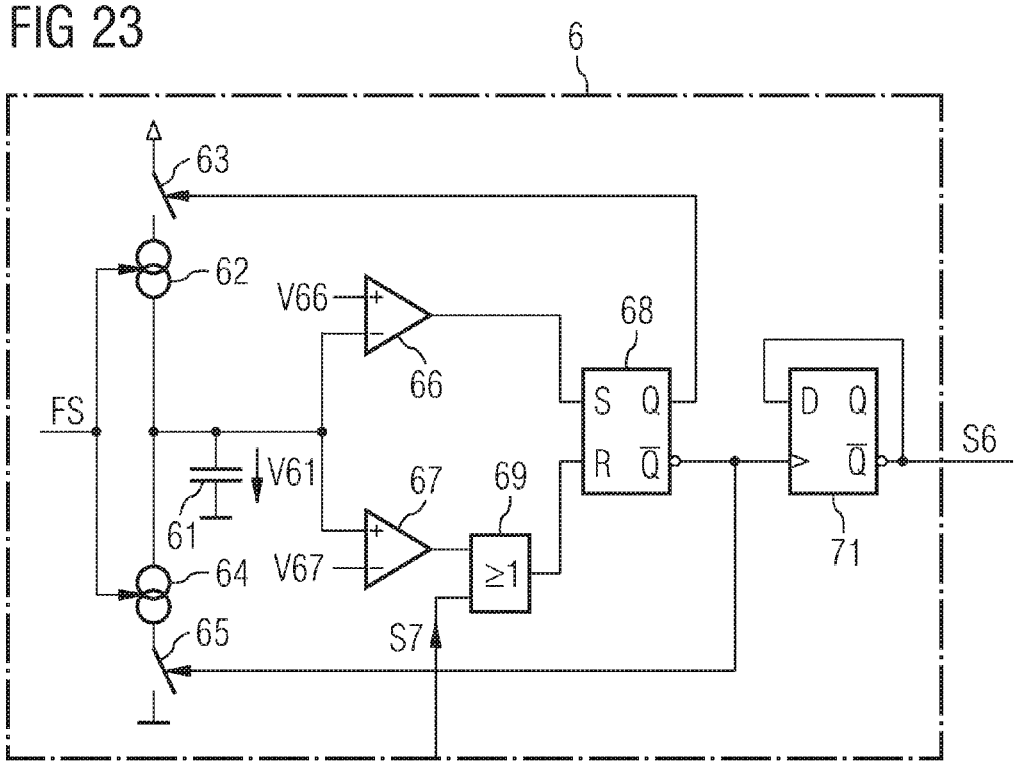
FIG. 23 illustrates a further exemplary embodiment of an oscillator.

An oscillator 6 in which a subsequent time for which the first switch T11 is switched on is likewise shortened when the time for which the second switch T12 is switched on is shortened, and in which the time for which the first switch T11 is switched on is, however, longer than the time for which the second switch is switched on, is illustrated in FIG. 23. This oscillator 9 differs from the oscillator 6 illustrated in FIG. 9 by having an additional flipflop 71, which is in the form of a toggle flipflop or D-flip-flop, and is connected downstream from the RS flipflop 69. A clock signal S6 from this oscillator is produced at the inverting output of this toggle flipflop, and is fed back to the D-input of the flipflop 71. A clock input of this toggle flipflop 71 is connected to the inverting output of the RS flip-flop.

In this oscillator, the clock signal S6 which is produced in the output of the toggle flipflop changes its signal level in each case whenever the upstream RS flipflop is reset. In this oscillator 6, the toggle flipflop 71 acts as a frequency divider, such that the frequency of the clock signal S6 corresponds to half the frequency of the signal produced at the output of the RS flipflop. One period of the clock signal corresponds to two charging and discharge cycles of the oscillator capacitor 61. The method of operation of the oscillator illustrated in FIG. 23 will become clear with reference to FIG. 24, which illustrates the signal waveforms of the clock signal S6, of the capacitor voltage V61 and of the signal S7 for premature resetting of the RS flipflop 69.

Figure 24:
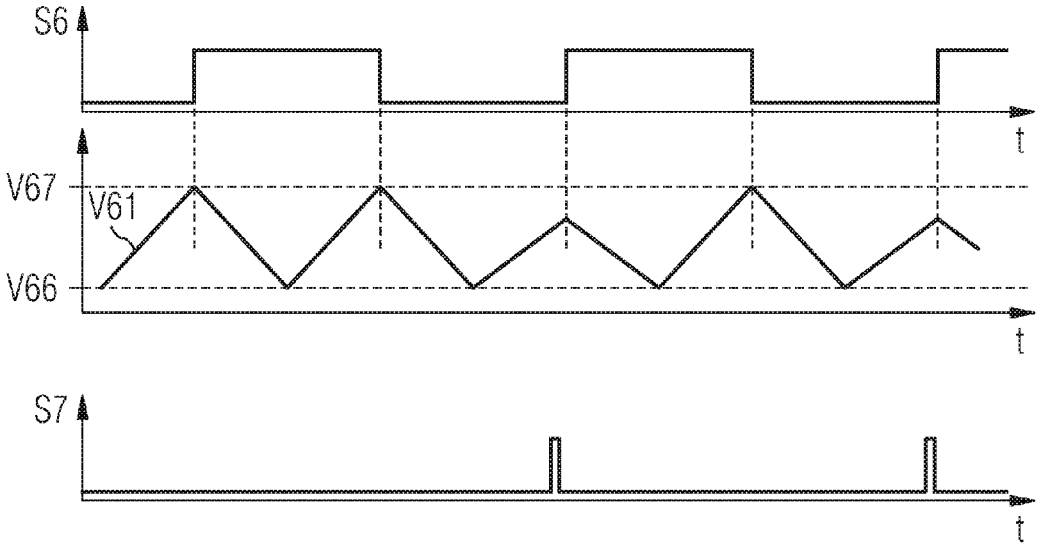
FIG. 24 illustrates the method of operation of the oscillator illustrated in FIG. 23, on the basis of signal waveforms.

The illustration in FIG. 24 is based on the assumption that the currents produced by the current sources 62, 64 in the oscillator 6 are not the same, specifically that the discharge current is greater than the charging current, thus resulting in the capacitor voltage V61 having an unbalanced triangular waveform.

With reference to FIG. 24, the time for which the first switch T11 is switched on and the time for which the second switch T12 is switched on each include one complete charging and discharge cycle of the capacitor 61. If the RS flipflop 69 is not reset prematurely, then the capacitor voltage V61 in each case varies between the lower and the upper limit value V66, V67, and the times for which the switches T11, T12 are switched on are then balanced.

If the RS flipflop is reset prematurely by the reset signal S7, then the charging or discharge cycle that is currently taking place for the capacitor 61 is interrupted. The illustration in FIG. 24 is based on the assumption that such premature resetting of the RS flipflop takes place when the clock signal S6 is at a low level, that is to say during a time for which the lower switch T12 is switched on, and during a charging cycle of the capacitor 61. Resetting the RS flipflop 69 ends the charging cycle of the capacitor 61 and starts the discharge cycle, with the clock signal S6 also changing to a high level. The clock signal S6 remains at the high level until the discharge cycle and the subsequent charging cycle have been completed. Owing to the imbalance in the triangular-waveform or sawtooth-waveform signal produced by the oscillator, if the RS flipflop is reset prematurely during the time in which the lower switch T12 is switched on, the next time for which the other switch is switched on will differ from the previous time for which the lower switch was switched on. In the illustrated example, the time for which the upper switch T11 is switched on is longer than the previous time for which the lower switch T12 was switched on.

This unbalanced shortening of the times for which the lower and upper switches T12, T11 are switched on can influence the control stability of the starting voltage control, for example when the excitation frequency approaches the resonant frequency for the second time, as explained with reference to FIG. 22.

It should be noted that the oscillator explained with reference to FIG. 23 can be used instead of the oscillator 6 for all of the ballasts that have been explained above.

Although specific embodiments have been illustrated and described herein, it will be appreciated by those of ordinary skill in the art that a variety of alternate and/or equivalent implementations may be substituted for the specific embodiments illustrated and described without departing from the scope of the present invention. This application is intended to cover any adaptations or variations of the specific embodiments discussed herein. Therefore, it is intended that this invention be limited only by the claims and the equivalents thereof.

What is claimed is:

1. A method for operating a fluorescent lamp, which is connected to a series resonant circuit having a resonant circuit inductance and a resonant circuit capacitance, the method comprising:

applying of an excitation AC voltage at an excitation frequency to the series resonant circuit using a half bridge circuit, which has an output to which the series resonant circuit is coupled, and which has a first and a second switch;

reducing excitation frequency for starting the fluorescent lamp; and increasing the excitation frequency, at least temporarily, when the rate of change of a peak value of the resonant circuit current is greater than a predetermined threshold value.

2. The method of claim 1, wherein the excitation frequency is increased by immediately switching off the switch which is on at that time.

3. A method for operating a fluorescent lamp, which is connected to a series resonant circuit having a resonant circuit inductance and a resonant circuit capacitance, the method comprising:

applying of an excitation AC voltage at an excitation frequency to the series resonant circuit using a half bridge circuit, which has an output to which the series resonant circuit is coupled, and which has a first and a second switch;

reducing excitation frequency for starting the fluorescent lamp, increasing the excitation frequency, at least temporarily, when a peak value of the resonant circuit current reaches a first threshold value;

causing a sudden phase change in the operation of the switches when the peak value of the resonant circuit current reaches a second threshold value;

ending the operation when the peak value of the resonant circuit current reaches a third threshold value; and the first threshold value being less than the second threshold value, and the second threshold value being less than the third threshold value.

4. A method for operating a fluorescent lamp, which is connected to a series resonant circuit having a resonant circuit inductance and a resonant circuit capacitance, the method comprising:

applying of an excitation AC voltage at an excitation frequency to the series resonant circuit using a half bridge circuit, which has an output to which the series resonant circuit is coupled, and which has a first and a second switch which are alternately switched on and off on the basis of a frequency signal; and determining a peak value of a current through the resonant circuit, and setting of the time for which the first and the second switch are switched on as a function of the frequency signal and the peak value.

5. The method of claim 4, wherein the time for which the first and second switches are switched on is shortened when the peak value exceeds the predetermined threshold value.

6. The method of claim 4, wherein the current through the half bridge is detected, and the half bridge is switched off when the half-bridge current exceeds a predetermined threshold value for a predetermined time period, with the predetermined time period assuming a first time period value within a time window after a switch-off flank of a drive signal for a switch which is on at that time in the half bridge, and otherwise assuming a second time period value which is shorter than the first time period value.

* * * * *